US006347419B1

(12) United States Patent
Kurtz

(10) Patent No.: US 6,347,419 B1
(45) Date of Patent: Feb. 19, 2002

(54) CLAMP-ON PORTABLE STORAGE ENDBOARD FOR A SLEEPING COT

(76) Inventor: Eugene D. Kurtz, 436 Colonial La., Dayton, OH (US) 45429

( * ) Notice: Subject to any disclaimer, the term of this patent is extended or adjusted under 35 U.S.C. 154(b) by 0 days.

(21) Appl. No.: 09/620,692

(22) Filed: Jul. 20, 2000

(51) Int. Cl.[7] ..... A47C 21/00

(52) U.S. Cl. ..... 5/503.1; 110/904; 110/905; 206/373; 206/579; 220/475

(58) Field of Search ..... 5/503.1, 110–117, 5/658, 904, 905; 206/579, 373; 220/475, 481, 482

(56) References Cited

U.S. PATENT DOCUMENTS

| | | | | | |
|---|---|---|---|---|---|
| 3,375,620 | A | * | 4/1968 | Phillips | 220/475 |
| 4,071,258 | A | | 1/1978 | Wallace | |
| 4,104,751 | A | | 8/1978 | Churchman | |
| 4,129,909 | A | | 12/1978 | Riehl | |
| D262,332 | S | | 12/1981 | Keller | |
| 4,312,465 | A | * | 1/1982 | Sinkmorn | 220/475 |
| D266,806 | S | | 11/1982 | Lenger, Jr. | |
| D273,260 | S | | 4/1984 | Kemp III, et al. | |
| 4,467,486 | A | | 8/1984 | Schatz | |
| 4,831,673 | A | | 5/1989 | Winckler | |
| 4,903,354 | A | | 2/1990 | Yeh | |
| 5,020,173 | A | | 6/1991 | Dreyer, Jr. | |
| 5,163,968 | A | | 11/1992 | Lafferty | |
| D353,733 | S | | 12/1994 | Turner | |
| D358,284 | S | | 5/1995 | Hill | |
| D370,143 | S | | 5/1996 | Brunner, et al. | |
| 5,651,152 | A | | 7/1997 | Ritchie, et al. | |
| 5,743,672 | A | | 4/1998 | Cline | |
| 5,758,972 | A | | 6/1998 | Mack, et al. | |
| 5,913,771 | A | | 6/1999 | Nail | |
| 5,924,615 | A | * | 7/1999 | McGratii | 220/482 |
| 6,233,765 | B1 | * | 5/2001 | Verhulst | 5/503.1 |

OTHER PUBLICATIONS

"Cot–Side Nightstand": Item © 51–3358 on Attached Brochure. Trademark "Field Pockets" . Trademark Sheet Attached. Referred to in my Specification as "Canvas Fabric Organizer".

"Cot–Tree": Item A 51–3718 on Attached Sales Brochure. Patent & Trademark Search Failed to Disclosure Additional Info. Referred to in my Specification as "Cot Rack".

* cited by examiner

*Primary Examiner*—Alexander Grosz

(57) ABSTRACT

A clamp-on storage endboard for a sleeping cot (E1) comprises a generally rectangular. open-top rigid container (60) with a bottom (62) and extending upward therefrom a front wall (64), a back wall (66), a left wall (6 and a right wall (70). A plurality of interior sidewalls (120) within container (60) bounds a plurality of recessed storage compartments (122). A latchable and lockable mating lid (80) is pivotally connected to container (60), and a beverage holder (98) and a carrying handle (100) are recessed into the upper surface (88) of lid (80). An eternally-accessed storage compartment (72) is centrally disposed to the lower half of container (60). A plurality of mounting bolt apertures (124 and 125), and a plurality of cot siderail clearance housings (106) in bottom (62) of container (60) allow for attachment of endboard (E1) to a variety of sleeping cots (C1, C2, and C3) through the use of a correlating mounting bracket clamp assembly (160, 260, 360, or 460).

21 Claims, 30 Drawing Sheets

CLAMP-ON PORTABLE STORAGE ENDBOARD FOR A SLEEPING COT

CROSS REFERENCE TO RELATED APPLICATIONS

Not Applicable

BACKGROUND

1. Field of the Invention

This invention relates to bedside storage devices, specifically to such a device designed for use with and attached to a sleeping cot.

2. Description of Prior Art

Storage of articles within easy reach of a sleeping bed is an important aspect of daily home life many people take for granted. For obvious reasons, many people prefer to have ready access to articles such as eyeglasses, flashlights, medicines, books, magazines, clocks, lights, radios, small self-defense weapons, and a variety of other articles while in bed at home or elsewhere, Articles of furniture such as nightstands or storage headboards usually provide bedside storage of such articles in the home or other permanent facility. Because they are more closely associated with the concept of the present invention, examples of prior-art storage bed headboards follow:

Kemp, III, et al., U.S. Pat. No. D273,260 discloses a combined headboard and hutch unit Lenger, Jr., U.S. Pat. No. D266,806 discloses a bed headboard or similar article Keller, U.S. Pat. No. D262,332 discloses a headboard The use of devices for attaching headboards to sleeping beds is also known in the prior art. The following patents are representative:

Cline, U.S. Pat. No. 5,743,672 discloses a headboard attaching bracket

Lafferty, U.S. Pat. No. 5,163,968 discloses headboard mounting hardware

Yeh, U.S. Pat. No. 4,903,354 discloses a headboard connecting device

Schatz, U.S. Pat. No. 4,467,486 discloses a headboard bracket

Although non-storage related, a few examples of bed endboards exist in the prior art. By way of example, Nail, U.S. Pat. No. 5,913,771 discloses an endboard for supporting a child's bed having moveable pieces slidably mounted thereon Churchman, U.S. Pat. No. 4,104,751 discloses an endboard auxiliary device for beds Brunner, et al., U.S. Pat. No. D370,143 discloses an endboard for a bed Turner, U.S. Pat. No. D353,733 discloses a bed endboard Alternative methods of bedside storage are also found in the prior art. The following patents are representative:

Mack, et al., U.S. Pat. No. 5,758,972 discloses an assisted sundries caddy bed based holding system Ritchie, et al. U.S. Pat. No. 5,651,152 discloses a storage organizer for hospital bed Dreyer Jr. U.S. Pat. No. 5,020,173 discloses a bedstead storage box Winckler U.S. Pat. No. 4,831,673 discloses an apparatus for holding articles to a bed Hill U.S. Pat. No. D358,284 discloses a bed storage compartment Riehl U.S. Pat. No. 4,129,909 discloses a bed storage article Wallace U.S. Pat. No. 4,071,258 discloses a mobile underbed storage container These devices may fulfill their respective objectives of bedside storage of articles in a bed-based sleeping environment such as that found in most homes, lodging facilities, and medical treatment facilities. They do not however, address a similar need in a cot-based sleeping environment such as that found where people are quartered under field conditions. In environments like this, such storage takes on even greater importance.

In an environment where people are quartered under field conditions such as camping, military bivouac, or temporary emergency sheltering, personal comfort issues figure prominently in the overall quality of the experience. Important among these issues are sleeping conditions and personal storage space immediately adjacent the sleeping area. Typically, such environments are characterized by cramped sleeping quarters inside a shelter such as a tent, cabin, lean-to, or crowded emergency shelter facility where sleeping conditions are marginal and personal space is extremely limited.

To improve sleeping conditions, many private individuals, as well as emergency management authorities, have taken to employing sleeping cots including the types shown in prior-art FIGS. 8, 14, and 20 of the drawings annexed herein. Although made of lightweight materials such as wood and aluminum, these folding cots are sturdy enough to support most adults and break down into compact packages for easy transport and storage making them perfectly suited for the aforementioned applications.

Regarding storage space in a cot-based sleeping environment, a beneficial by-product of the use of these cots is the area directly beneath the cot itself, henceforth "underspace," which provides a relatively large amount of space suitable for storing many miscellaneous articles such as luggage and articles of clothing. However, this underspace does not lend itself to the storage of certain types of articles, such as those that are fragile, valuable, and which, especially in a cot-based sleeping environment under field conditions, must be kept readily accessible. Among others, these articles may include eyeglasses, flashlights, wallets, money clips, watches, jewelry, keys, medicines, cellular phones, cameras, pagers, and, in some cases, small personal defense weapons.

Few examples of devices specifically designed to provide storage of articles on a sleeping cot are known in the prior art. One is the development of a canvas fabric organizer, Trademark "Field Pockets", Owner: Darlene Webster, Reg. No., 2187104. Reg. Date: Sep. 8, 1998, shown in FIG. 1 "for draping over a military cot or camp cot." This contrivance does not lend itself to storage of fragile and/or valuable articles because it stores articles in either an exposed or unsecured manner in thin fabric or fabric mesh pockets. Stored articles can thus be easily stolen, or damaged by accidental impact with people and or objects moving or being moved about cramped sleeping quarters. Also, the contrivance itself may interfere with the fluid mounting and dismounting of the cot's sleeping surface, or entry into or exit from a sleeping bag thereon. Most importantly however, the organizer's low-slung hanging position along the entire length of the cot renders the cot's valuable underspace storage area virtually inaccessible on the side of the cot from which the organizer hangs. This may necessitate placing the cot away from the wall of a tent, where cots are normally located, to facilitate access to its underspace on the side opposite that from which the organizer is hung. This would further reduce the already limited overall space found in most camping, bivouac, and sheltering situations. Another example of prior art is the development of a cot rack, sold as "Cot-Tree," shown in FIG. 2. This contrivance comprises two vertical poles attached to opposite corners of one end of a sleeping cot by hook and loop straps with their upper ends joined and stabilized by a horizontal pole. Hooks spaced intermittently on these vertical poles allow for storage by hanging of slinged rifles, backpacks, articles of clothing, and other hangable accoutrements. This contrivance also does not lend itself to storage of certain articles because it is limited by design to storing only those articles that may be hung on a hook in an exposed position where they can be easily stolen or damaged. Moreover, because of its height, use of this contrivance is limited to areas with considerable headroom thereby precluding its use within smaller and sharply sloping shelters such as many camping tents. Use of this contrivance may necessitate placing the cot away from the wall of a tent, where cots are normally located, to accommodate its additional height. This would further reduce the already limited overall space found in most camping, bivouac, and sheltering situations.

The utility of both these contrivances is further limited in that they can function as storage devices only in a static state and must first be emptied of articles before they can be moved. They can not be used to transport articles to and from a cot-based sleeping environment and therefore lack true functional portability.

Shortcomings notwithstanding, these contrivances evidence the need for a device that will protectively store on a sleeping cot articles that are fragile, valuable, and of potentially immediate need in a cot-based sleeping environment and do so without hampering access to the cot's sleeping surface or its underspace storage area.

SUMMARY

In accordance with the present invention, a clamp-on portable storage endboard for a sleeping cot comprises an open-top rigid container with a bottom and extending upward therefrom a front wall, a back wall, a left wall, and a right wall. The container is generally rectangular in shape with a predetermined height, length, and width. A plurality of interior sidewalls within the container bounds recessed compartmented storage areas. A latchable and lockable mating lid is pivotally connected to the container, and a beverage holder and carrying handle are recessed into the lid's upper surface. An externally-accessed storage compartment is disposed to the lower half of the container. Mounting bolt apertures and cot siderail clearance housings in the bottom of the container facilitate attachment of the endboard to a variety of sleeping cots through the use of a correlating mounting bracket clamp assembly. These assemblies clamp the endboard to the crossarms of the type sleeping cot they were designed to accommodate such that they cannot be removed from outside the endboard once the endboard is closed and locked thus protecting the articles stored therein from damage or theft.

Thus has been outlined, rather broadly, the more important features of my storage endboard in order that the detailed description thereof that follows may be better understood, and in order that its contribution to the field may be better appreciated. There are, of course, additional features of my storage endboard that will be described hereinafter and which will form the subject matter of the claims appended hereto. Thus before explaining two embodiments of my endboard in detail, it is to be understood that it is not limited in its application to the details of its construction or arrangements of its components set forth in the following description or illustrated in the drawings. My endboard is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, methods, and systems for carrying out the several purposes of my endboard. It is important; therefore, that the claims be regarded as including such equivalent constructions in so far as they do not depart from the spirit and scope of my endboard.

Further, the purpose of the abstract is to enable U.S. Patent and Trademark Office personnel, scientists, engineers, practitioners in the art, and the general public, to quickly determine the essence of the technical disclosure of the application. The abstract is neither intended to define the invention of the application, which is measured by the claims, or limit its scope in any way.

OBJECT AND ADVANTAGES

Accordingly, besides the objects and advantages of my storage endboard described above, several additional objects and advantages of my endboard are:

(a) To provide a storage endboard for a sleeping cot that will proximately and protectively store articles that are fragile, valuable, or of potentially immediate need in a cot-based sleeping environment such as camping, military bivouac, and temporary emergency sheltering.

(b) To provide a storage endboard for a sleeping cot that can be quickly and securely mounted to a cot through the use of a correlating mounting clamp assembly (c) To provide a storage endboard for a sleeping cot mounted to the cot such that its mounting clamp cannot be removed from outside the endboard when the endboard is closed and locked without structural damage to the endboard or the sleeping cot.

(d) To provide a storage endboard for a sleeping cot that will not block access to the storage space directly beneath a sleeping cot.

(e) To provide a storage endboard for a sleeping cot that will not impede fluid access to the cot's sleeping surface or fluid entry into or out of a sleeping bag thereon.

(f) To provide a storage endboard for a sleeping cot that will store articles both while in place on the cot and in transit thereto and therefrom.

(g) To provide a storage endboard for a sleeping cot which will not increase the cot's overall height to an extent that would require the cot be placed farther away from a shelter wall than necessary otherwise thereby potentially reducing the overall available space within that shelter.

(h) To provide a storage endboard for a sleeping cot that will, when used as a headboard, serve to retain a pillow in place at the head of the cot's sleeping surface.

(i) To provide a storage endboard for a sleeping cot that may serve as a console to house amenities that include but are not limited to a beverage holder, reading light, digital alarm clock, and radio.

(j) To provide a storage endboard for a sleeping cot that can be attached to a variety of sleeping cots without the use of tools.

Further objects and advantages of my endboard will become apparent from a consideration of the drawings and ensuing description.

DRAWING FIGURES

My endboard will be better understood and objects other than those set forth above will become apparent when consideration is given to the following detailed description thereof Such description makes reference to the annexed drawings wherein.

Reference Numerals in Drawings

Figure 1:
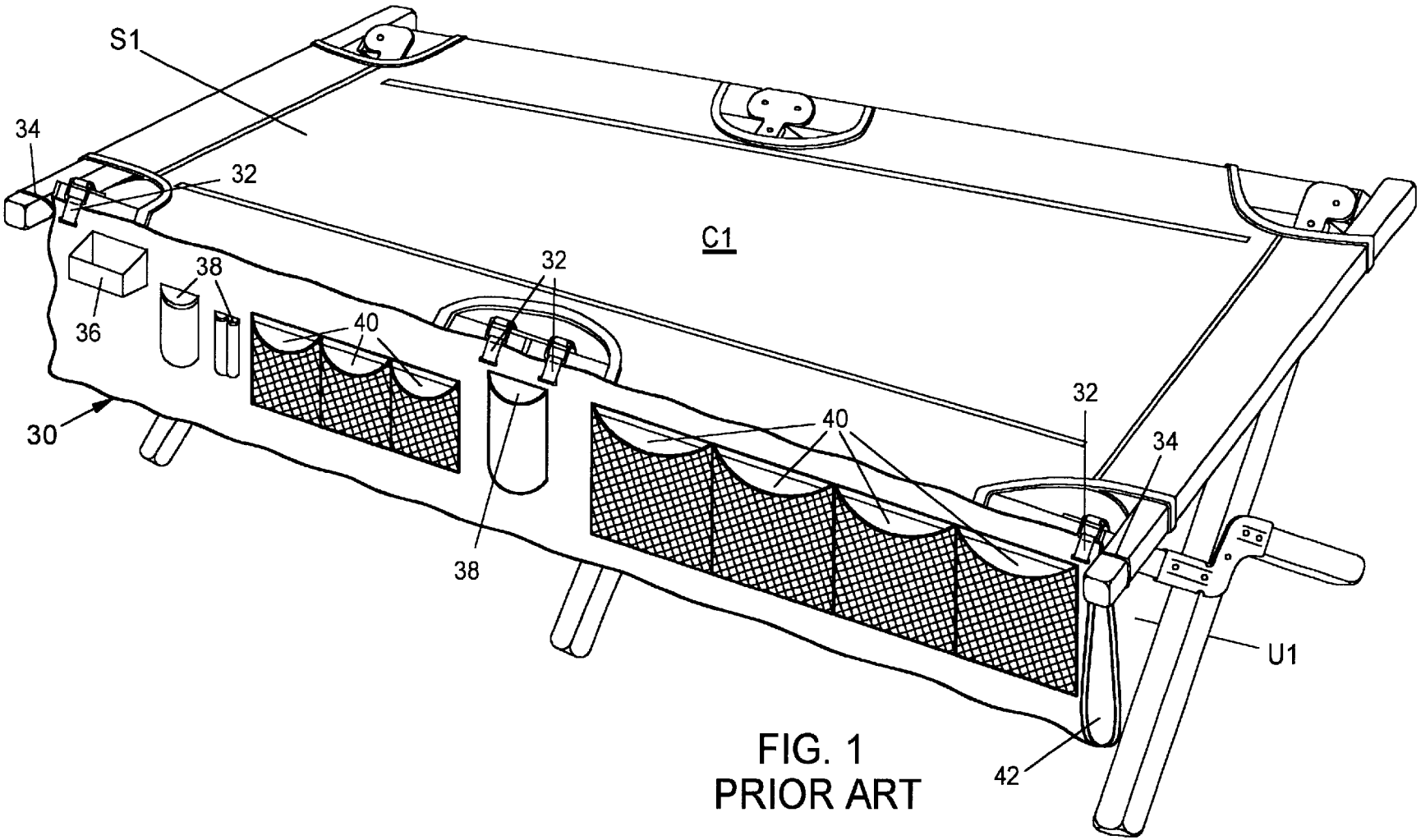
FIG. 1 PRIOR ART
FIG. 1 is a front perspective view from above depicting a prior-art canvas fabric organizer draped over the side of a prior-art sleeping cot.

E1 clamp-on portable storage endboard for a sleeping cot-Preferred Embodiment

E2 clamp-on portable storage endboard for a sleeping cot-Alternative Embodiment

C1 angular frame aluminum or wood sleeping cot (Prior Art)

C2 angular frame heavy gauge aluminum sleeping cot; AKA "Army Cot" (Prior Art)

C3 tubular frame aluminum sleeping cot (Prior Art)

S1 sleeping surface of sleeping cot type C1

S2 sleeping surface of sleeping cot type C2

S3 sleeping surface of sleeping cot type C3

U1 underspace storage area of sleeping cot type C1

U2 underspace storage area of sleeping cot type C2

U3 underspace storage area of sleeping cot type C3

| Reference Numerals in Drawings | |
|---|---|
| E1 | clamp-on portable storage endboard for a sleeping cot-Preferred Embodiment |
| E2 | clamp-on portable storage endboard for a sleeping cot-Alternative Embodiment |
| C1 | angular frame aluminum or wood sleeping cot (Prior Art) |
| C2 | angular frame heavy gauge aluminum sleeping cot; AKA "Army Cot" (Prior Art) |
| C3 | tubular frame aluminum sleeping cot (Prior Art) |
| S1 | sleeping surface of sleeping cot type C1 |
| S2 | sleeping surface of sleeping cot type C2 |
| S3 | sleeping surface of sleeping cot type C3 |
| U1 | underspace storage area of sleeping cot type C1 |
| U2 | underspace storage area of sleeping cot type C2 |
| U3 | underspace storage area of sleeping cot type C3 |
| 30 | canvas fabric organizer (Prior Art) |
| 32 | hook and loop belt |
| 34 | elastic loop |
| 36 | semi-rigid platform |
| 38 | fabric covered pocket |
| 40 | expandable net pocket |
| 42 | gun sleeve |
| 50 | cot rack (Prior Art) |
| 52 | horizontal cot rack pole |
| 54 | vertical cot rack pole |
| 56 | hook and loop strap |
| 58 | cot rack hook |
| 60 | container of endboard |
| 62 | bottom of container |
| 64 | front wall of container |
| 66 | back wall of container |
| 68 | left wall of container |
| 70 | right wall of container |
| 72 | externally-accessed storage compartment |
| 80 | mating lid of endboard |
| 82 | conventional hinge |
| 84 | front of mating lid |
| 85 | back of mating lid |
| 86 | left end of mating lid |
| 87 | right end of mating lid |
| 88 | upper surface of mating lid |
| 90 | annular lip portion of mating lid |
| 92 | latch |
| 94 | upper locking lug |
| 96 | locking lug eyelet |
| 98 | beverage holder |
| 100 | pliable carrying handle |
| 102 | carrying handle mounting aperture |
| 104 | handle storage bay |
| 106 | cot siderail clearance housing |
| 110 | annular lip portion of container |
| 112 | latching lug |
| 114 | lower locking lug |
| 118 | tenon of annular lip portion |
| 120 | interior sidewall |
| 122 | internally-accessed storage compartment |
| 124 | small T-shaped mounting bolt aperture |
| 125 | large rectangular mounting bolt aperture |
| 126 | lower surface of mating lid |

-continued

| Reference Numerals in Drawings | |
|---|---|
| 130 | digital alarm clock |
| 132 | am/fm/weather radio |
| 134 | dual-purpose retractable light |
| 136 | channel aperture housing for retractable light |
| 138 | battery compartment access panel to radio |
| 140 | angular frame of sleeping cot type C1 |
| 142 | crossarm of sleeping cot type C1 |
| 144 | siderail of sleeping cot type C1 |
| 146 | leg of sleeping cot type C1 |
| 148 | center leg-support bracket of cot type C1 |
| 150 | end leg-support bracket of sleeping cot type C1 |
| 152 | leg-connecting bracket of sleeping cot type C1 |
| 160 | angular-frame U-bolt mounting bracket clamp assembly |
| 162 | small wingnut |
| 164 | small washer |
| 166 | two-hole washer plate |
| 168 | elongated small mounting bolt aperture |
| 170 | U-bolt |
| 240 | angular frame of sleeping cot type C2 |
| 242 | crossarm of sleeping cot type C2 |
| 243 | circular sleeping surface tensioning aperture of sleeping cot type C2 |
| 244 | siderail of sleeping cot type C2 |
| 246 | leg of sleeping cot type C2 |
| 248 | center leg-support bracket of cot type C2 |
| 250 | end leg-support bracket of sleeping cot type C2 |
| 252 | leg-connecting bracket of sleeping cot type C2 |
| 260 | angular-frame arrester mounting bracket clamp assembly |
| 262 | large wingnut |
| 264 | large washer |
| 266 | one-hole washer plate |
| 268 | large circular mounting bolt aperture |
| 270 | arrester mounting bracket |
| 272 | large mounting bolt |
| 274 | head of large mounting bolt |
| 276 | square shank portion of large mounting bolt |
| 280 | base plate of arrester mounting bracket |
| 284 | vertical member of arrester mounting bracket |
| 286 | horizontal member of arrester mounting bracket |
| 340 | tubular frame of sleeping cot type C3 |
| 342 | crossarm of sleeping cot type C3 |
| 344 | siderail of sleeping cot type C3 |
| 346 | leg of sleeping cot type C3 |
| 348 | center leg-support bracket of sleeping cot type C3 |
| 350 | end leg-support bracket of sleeping cot type C3 |
| 360 | tubular-frame anti-roll mounting bracket clamp assembly |
| 362 | small mounting bolt |
| 364 | head of small mounting bolt |
| 366 | square shank portion of small mounting bolt assembly |
| 370 | anti-roll mounting bracket |
| 372 | curved base of anti-roll mounting bracket |
| 374 | left horizontal arm member of tubular-frame mounting bracket |
| 376 | right horizontal arm member of tubular-frame mounting bracket |
| 377 | small rectangular mounting bolt aperture |
| 380 | anti-roll outrigger |
| 382 | flat end of anti-roll outrigger |
| 384 | crooked end of anti-roll outrigger |
| 387 | elongated small rectangular mounting bolt aperture |
| 460 | angular-frame adjustable mounting bracket clamp assembly |
| 470 | adjustable mounting bracket |
| 480 | male bracket component |
| 482 | vertical trunk member of male bracket component |
| 484 | upper horizontal male arm member of male bracket component |
| 486 | lower horizontal male arm member of male bracket component |
| 488 | elongated thumbscrew drag slot |
| 490 | female bracket component |

-continued

| Reference Numerals in Drawings | |
|---|---|
| 492 | vertical trunk member of female bracket component |
| 494 | upper horizontal female arm member of female bracket component |
| 496 | lower horizontal female arm member of female bracket component |
| 497 | guide channel in female bracket component |
| 498 | threaded aperture in female bracket component |
| 500 | retaining thumbscrew |

DESCRIPTION

Prior Art

FIG. 1—Canvas Fabric Organizer 30

In FIG. 1 a prior-art development in the area of sleeping cot storage devices includes a canvas fabric organizer 30 attached to a typical prior-all sleeping cot type C1 by a plurality of hook and loop belts 32 and a plurality of elastic loops 34. Cot type C1 has a generally rectangular horizontally disposed fabric sleeping surface S1 with an underspace storage area U1 directly beneath. Storage on organizer 30 is provided by various sewn-in features which include a small horizontally-disposed semi-rigid platform 36, a plurality of variably-sized, vertically-disposed fabric covered pockets 38, a plurality of variably-sized vertically-disposed expandable net pockets 40, and a horizontally-disposed gun sleeve 42. Gun sleeve 42 is formed by the doubling over and sewing together of the long edges of organizer 30. This drawing shows how articles stored in or on organizer 30 are generally exposed and thereby subject to damage or theft rendering organizer 30 only marginally suitable for storing articles that are valuable or fragile. The drawing further shows how placement of organizer 30 may impede fluid access to sleeping surface S1 and effectively block access to underspace storage area U1 from the side of cot type C1 on which it is draped. Most cots of any type are placed against the walls of a tent or small shelter to best utilize available space and facilitate ingress and egress. Therefore, one can see that use of organizer 30 virtually eliminates access to underspace U1 from the side of cot type C1 on which organizer 30 is draped. At a minimum, it requires cot type C1 be placed away from the wall of a shelter to allow access to underspace U1 from the side opposite that on which organizer 30 is draped. This in turn results in more space needed per cot and therefore less space available overall within a shelter.

FIG. 2—Cot Rack 50

Figure 2:
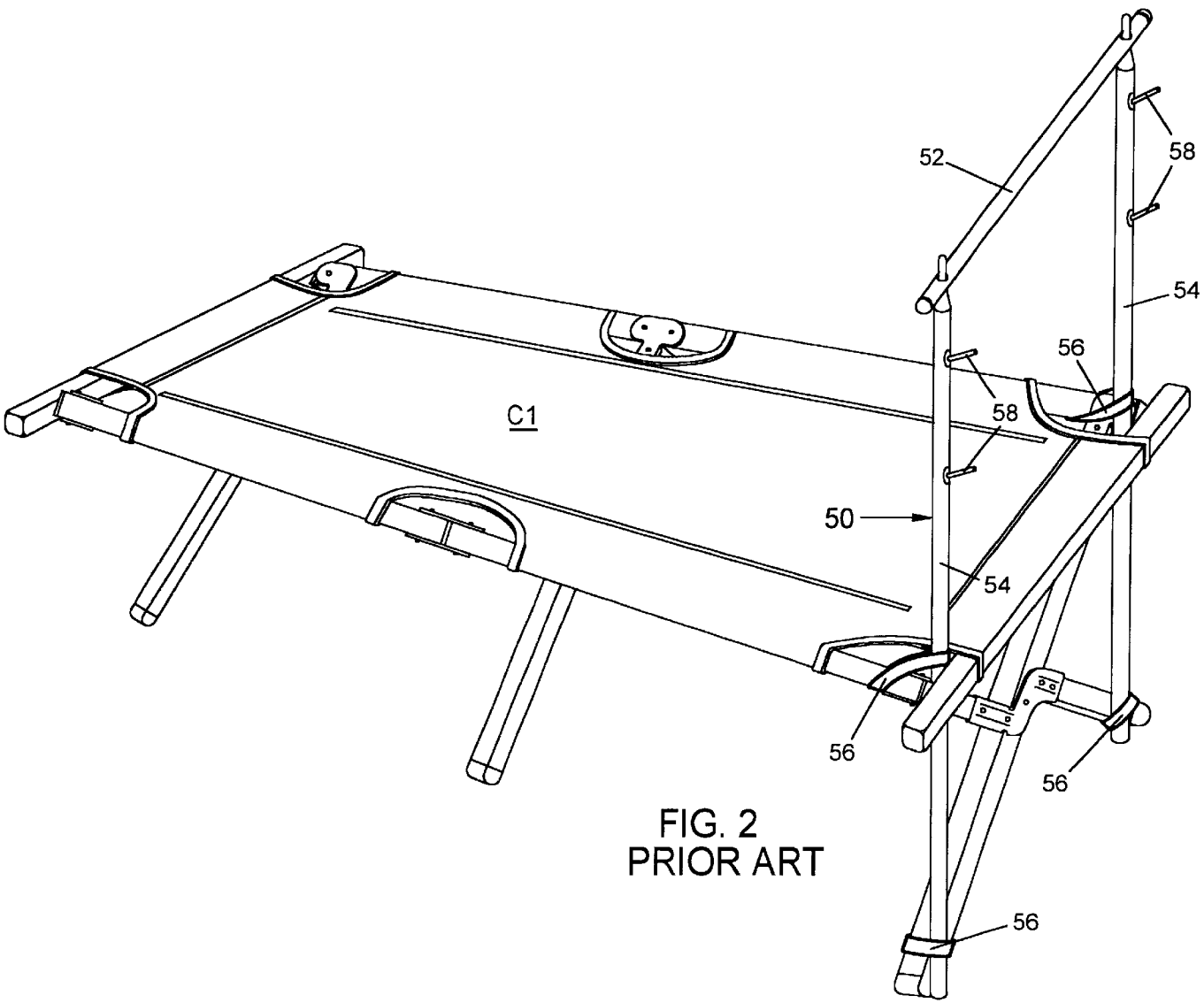
FIG. 2 PRIOR ART
FIG. 2 is a front perspective view from above depicting a prior-art cot rack strapped to the end of a prior-art sleeping cot.

In FIG. 2 another prior-art development in the area of sleeping cot storage devices includes a cot rack 50 comprising a horizontal cot rack pole 52 and a plurality of vertical cot rack poles 54. Lower ends of vertical poles 54 are secured to opposite corners of sleeping cot type C1 with a plurality of hook and loop straps 56. And upper ends of vertical poles 54 are joined and stabilized by horizontal pole 52. A plurality of cot rack hooks 58 are spaced intermittently on vertical poles 54 for hanging of articles such as knapsacks, slinged rifles, and articles of clothing. This drawing shows rack 50 is limited by design to storing only those articles which may be hung on a hook thereby exposing and subjecting them to theft or damage. This renders rack 50 only marginally suitable for storing articles that are valuable or fragile. Moreover, because of its height, use of rack 50 is limited to areas with considerable headroom thereby precluding its use within smaller and sharply sloping shelters such as many camping tents. Or, at a minimum, it requires cot type C1 be placed in a more central location within the shelter to accommodate the height of rack 50. This in turn results in more space needed per cot and therefore less space available overall within a shelter.

Present Invention

Figure 3:
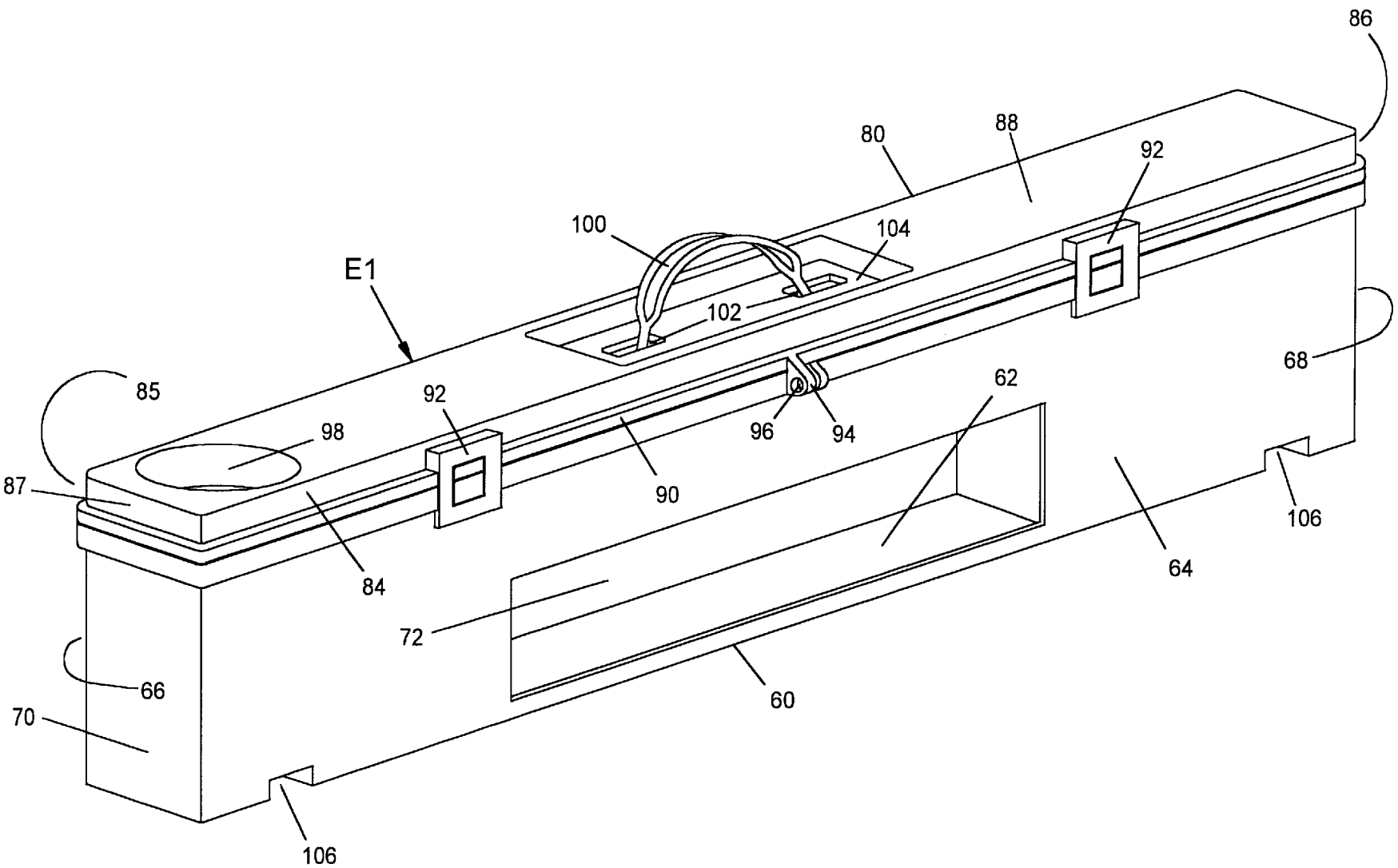
FIG. 3 is a front perspective view from above of a preferred embodiment of a clamp-on portable storage endboard for a sleeping cot with lid closed.
Figure 4:
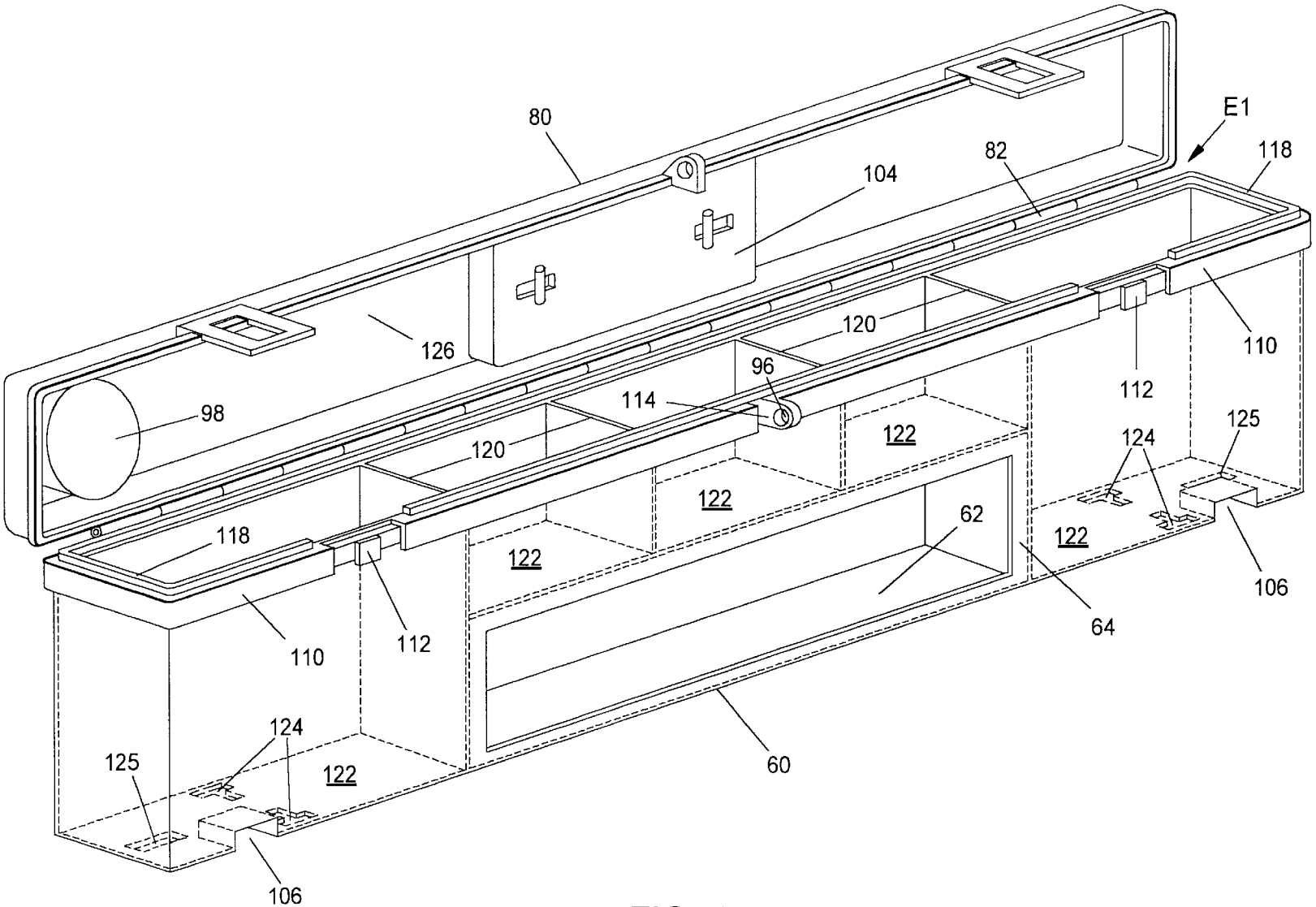
FIG. 4 is a front perspective transparent view from above of a preferred embodiment of the storage endboard with lid open disclosing a sample configuration of storage compartments and position of mounting apertures and cot siderail clearance housings in the bottom of the storage endboard.
Figure 5:
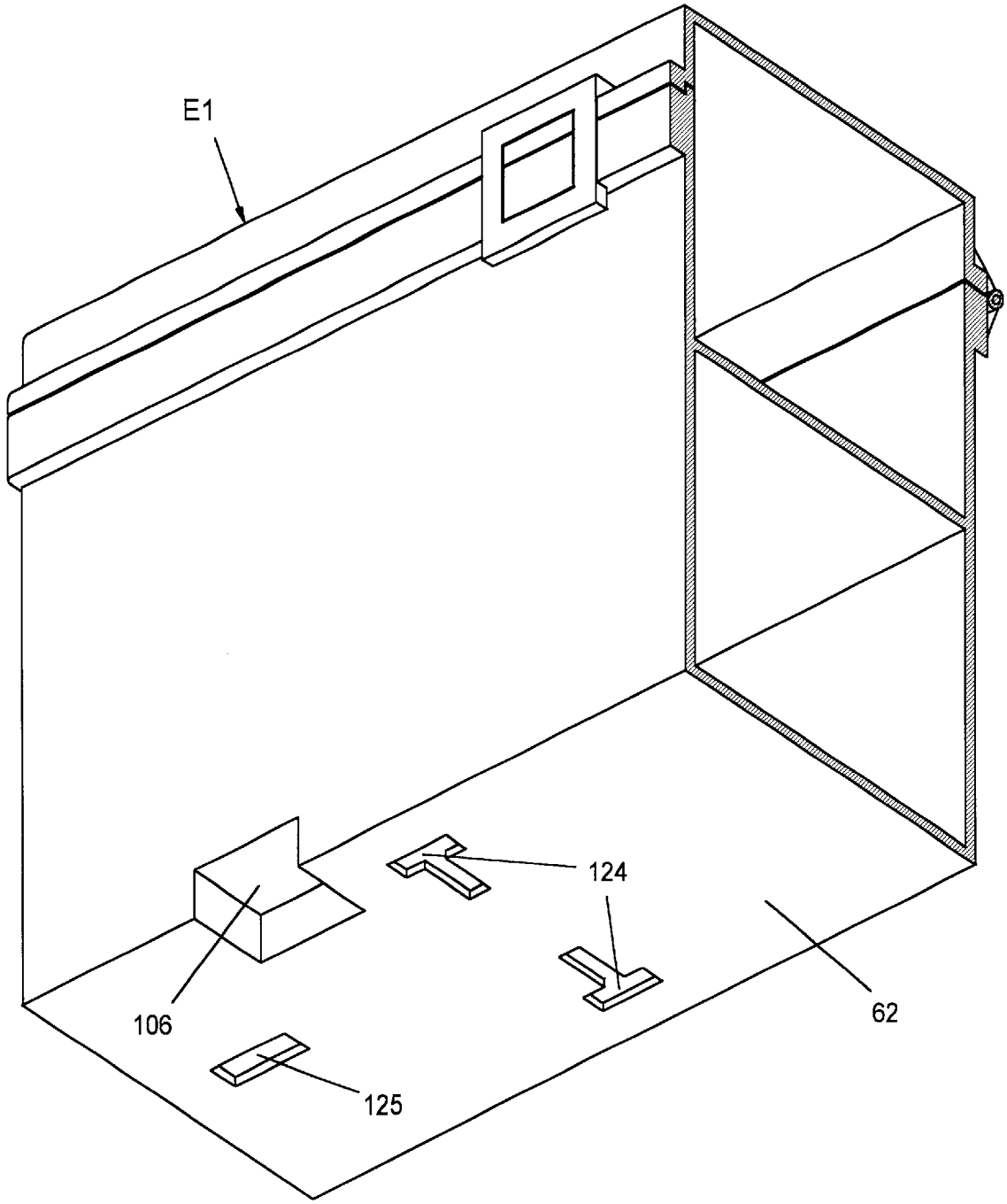
FIG. 5 is a front perspective sectional view from below of the bottom of the right side of the preferred embodiment of the storage endboard detailing the juxtaposition of the mounting apertures and cot siderail clearance housing therein.

FIGS. 3–5—Preferred Embodiment Endboard E1

In FIG. 3 a preferred embodiment of a new clamp-on portable storage endboard for a sleeping cot E1 includes a rigid container 60 with a bottom 62 and extending upwardly therefrom a front wall 64, a back wall 66, a left wall 68, a right wall 70. Container 60 is generally rectangular in shape with a predetermined height, length, and width. An eternally-accessed storage compartment 72 is centrally disposed to the lower half of container 60. A mating lid 80 is pivotally connected to container 60 by a conventional hinge (82) and has a front 84, a back 85, a left end 86, a 87, and an upper surface 88. An annular lip portion 90 projects outwardly from the lower periphery of lid 80. A plurality of latches 92 is disposed to front 84 of lid 80, and an upper locking lug 94 with an eyelet 96 projects from annular lip portion 90 in front 84 of lid 80. A beverage holder 98 is recessed into the right side of upper surface88 of lid 80. And a pliable carrying handle 100 is disposed through a plurality of carrying handle mounting apertures 102 in a recessed handle storage bay 104 centrally disposed to upper surface 88 of lid 80. A plurality of cot siderail clearance housings 106 is disposed to predetermined positions in bottom 62 of container 60.

In FIG. 4 opened lid 80 of preferred embodiment of storage endboard E1 reveals open top of container 60 with an annular lip portion 110 projecting outwardly from the upper periphery thereof. A plurality of latching lugs 112 is incorporated into lip portion 110 in front wall 64 of container 60. A lower locking lug 114 with eyelet 96 projects outwardly from lip portion 110 in front wall 64 of container 60. And a tenon 118 projects upwardly from upper surface of lip portion 110. A plurality of interior sidewalls 120 within container 60 bounds a plurality of recessed, internally-accessed storage compartments 122 configured in accordance with the preferred embodiment. Bottom 62 of container 60 includes a plurality of small T-shaped mounting bolt apertures 124, a plurality of large rectangular mounting bolt apertures 125, and cot siderail clearance housings 106. Opened lid 80 reveals a lower surface 126 and the undersides of beverage holder 98 and handle storage bay 104.

In FIG. 5 the juxtaposition of bolt apertures 124 and 125 and clearance housing 106 in bottom 62 of the right side of endboard E1 is more clearly detailed (opposite side of endboard E1 corresponds) (figure also applies to alternative embodiment of storage endboard E2).

Figure 6:
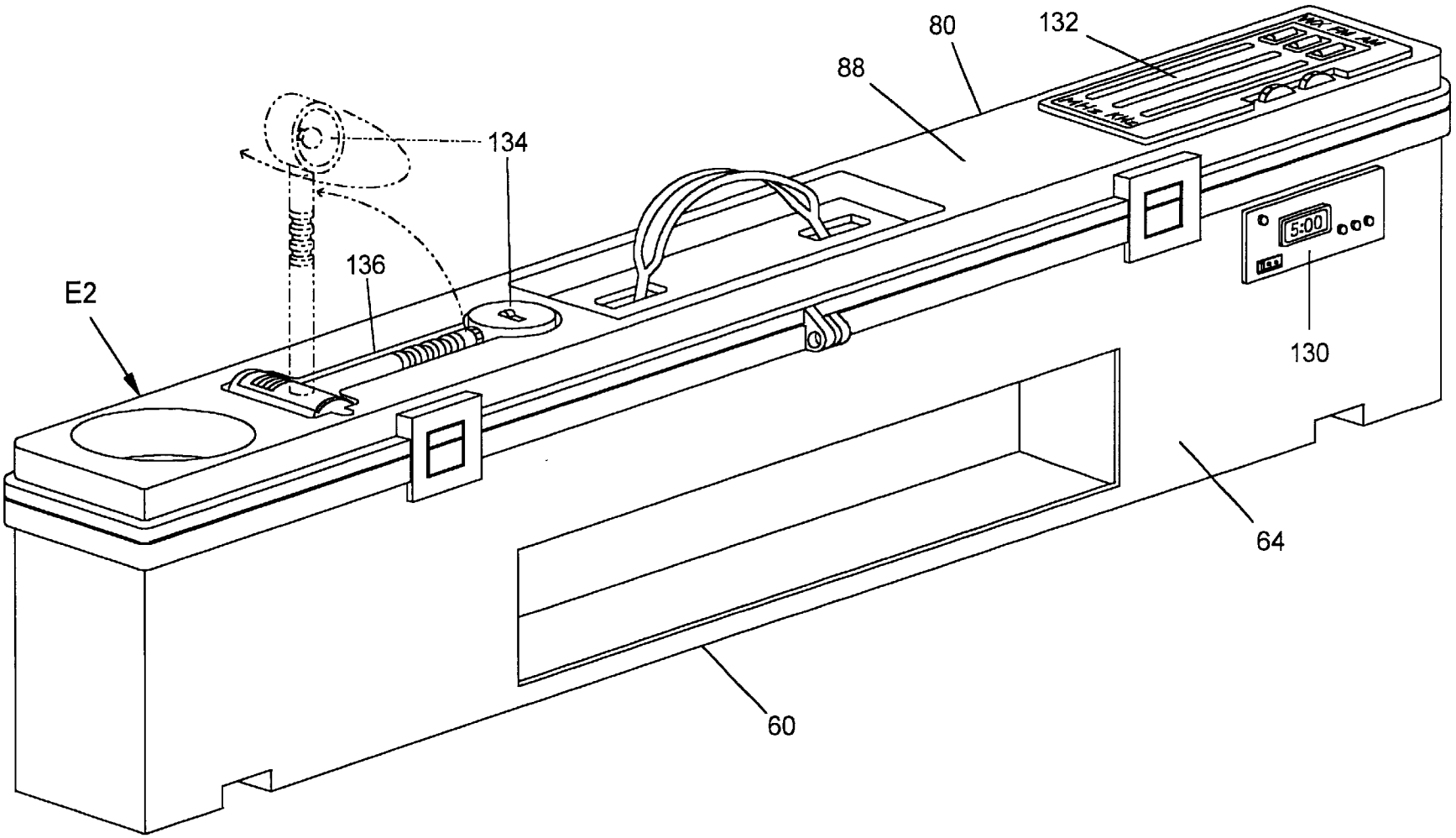
FIG. 6 is a front perspective view from above of an alternative embodiment of the storage endboard with lid closed which incorporates all the features of the preferred embodiment plus a digital alarm clock, a dual-purpose retractable light, and an am/fm/weather radio.
Figure 7:
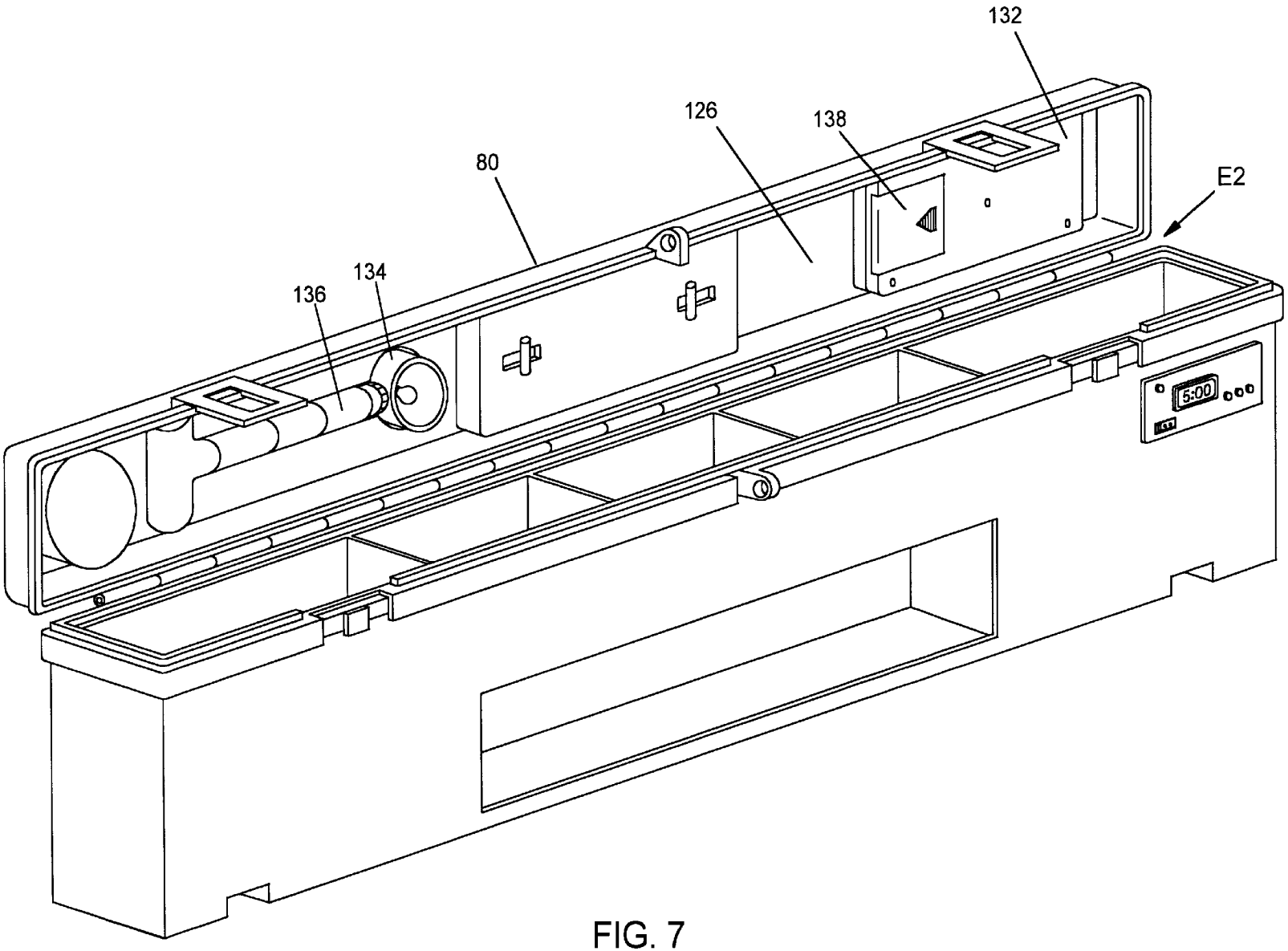
FIG. 7 is a front perspective view from above of the alternative embodiment of the storage endboard with lid open further detailing the additional electronic appliances depicted in FIG. 6.

FIGS. 6–7—Alternative Embodiment Endboard E2

In FIG. 6 an alternative embodiment of a new clamp-on portable storage endboard for a sleeping cot E2 includes all the features of the preferred embodiment plus additional features. These additional features include a digital alarm clock 130, an am/fm/weather radio 132, and a dual-purpose retractable light 134. Clock 130 is disposed to front wall 64 of the left side of container 60. Radio 132 and light 134 are recessed into left and right sides of upper surface 88 of closed lid 80 respectively, with light 134 shown stowed in a channel aperture housing 136 and deployed (phantom) in its compartment illumination and reading light modes respectively. Clock 130, radio 132, and light 134 are battery powered.

In FIG. 7 lower surface 126 of opened lid 80 of storage endboard E2 reveals a battery compartment access panel 138 for radio 132, and light 134 stowed in channel aperture housing 136 for use in its compartment illumination mode.

Figure 8:
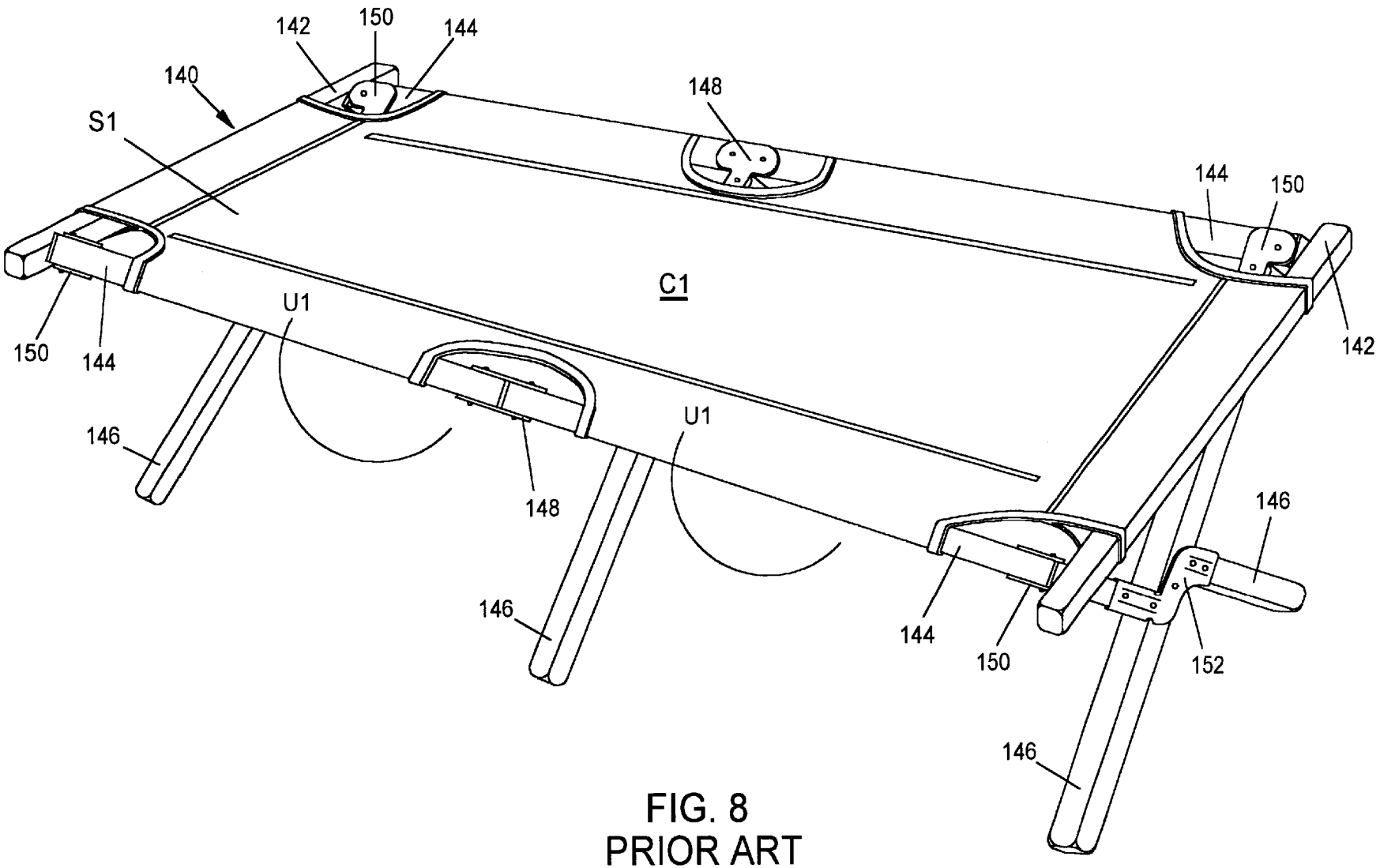
FIG. 8 PRIOR ART
FIG. 8 is a front perspective view from above depicting a prior-art sleeping cot of a general type with an angular frame used in the first and fourth mounting applications of the preferred and alternative embodiments of the storage endboard for a sleeping cot.

FIGS. 8–13—Preferred Embodiment Endboard E1 and Sleeping Cot Type C1 in a First Mounting Application In FIG. 8 sleeping cot type C1, usually constructed of wood or medium gauge aluminum, includes sleeping surface S1 supported by an angular frame 140 which is supported by a plurality of legs 146. Angular frame 140 comprises a plurality of crossarms 142 and a plurality of adjoining siderails 144. Legs 146 are attached to siderails 144 by a center leg-support bracket 148 or an end leg-support bracket 150. Opposing legs 146 are attached to each other by a leg-connecting bracket 152. The area immediately beneath sleeping surface S1 comprises underspace storage area U1.

Figure 9:
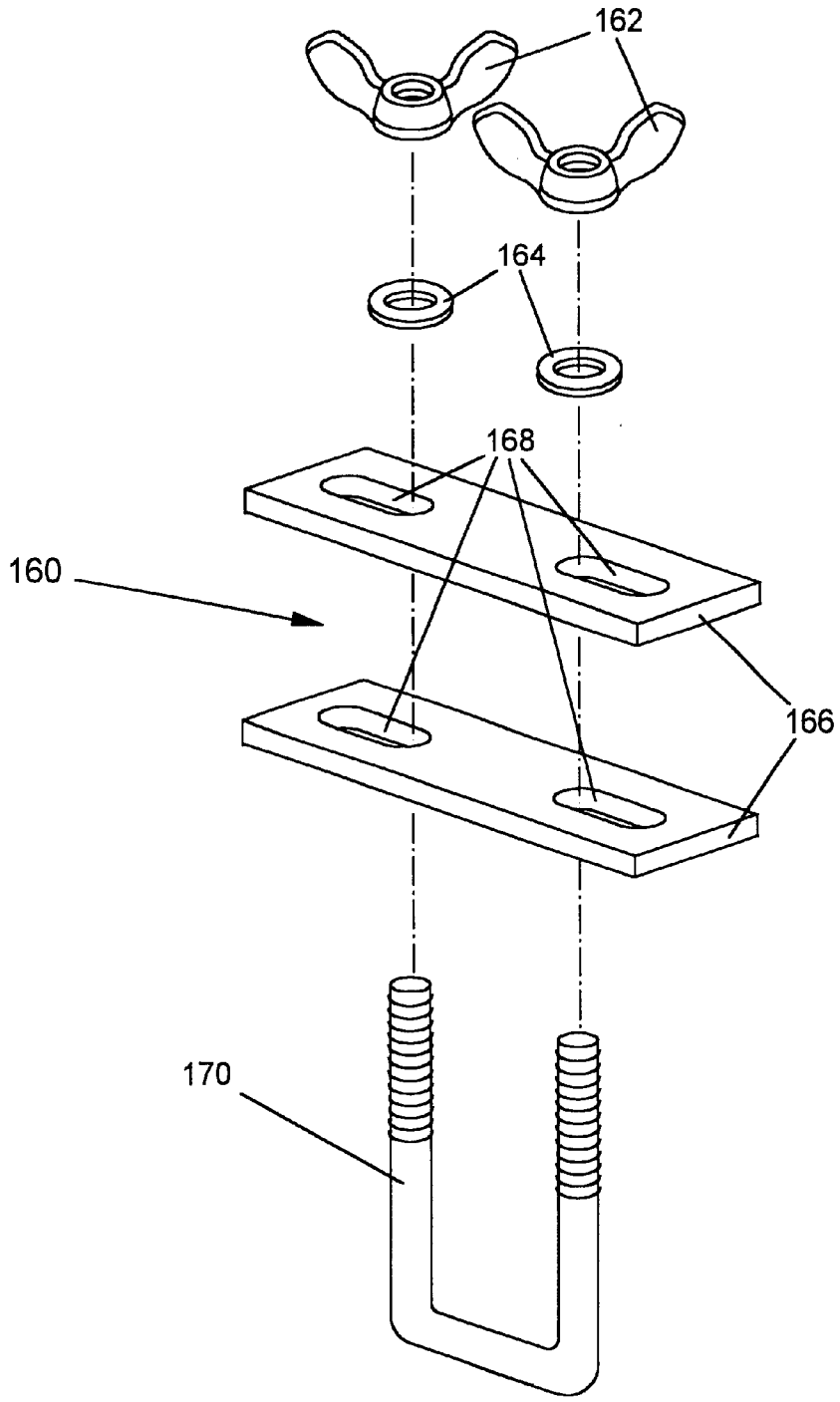
FIG. 9 is a front perspective view from above depicting an angular-frame U-bolt mounting bracket clamp assembly used in a first mounting application to attach the preferred embodiment of the storage endboard to the type sleeping cot depicted in FIG. 8.

In FIG. 9 an angular-frame U-bolt mounting bracket clamp assembly 160 comprises a plurality of small wingnuts 162, a plurality of small washers 164, a plurality of two-hole washer plates 166, and a U-bolt 170. An elongated small mounting bolt aperture 168 is disposed to a predetermined position at each end of each washer plate 166.

Figure 10:
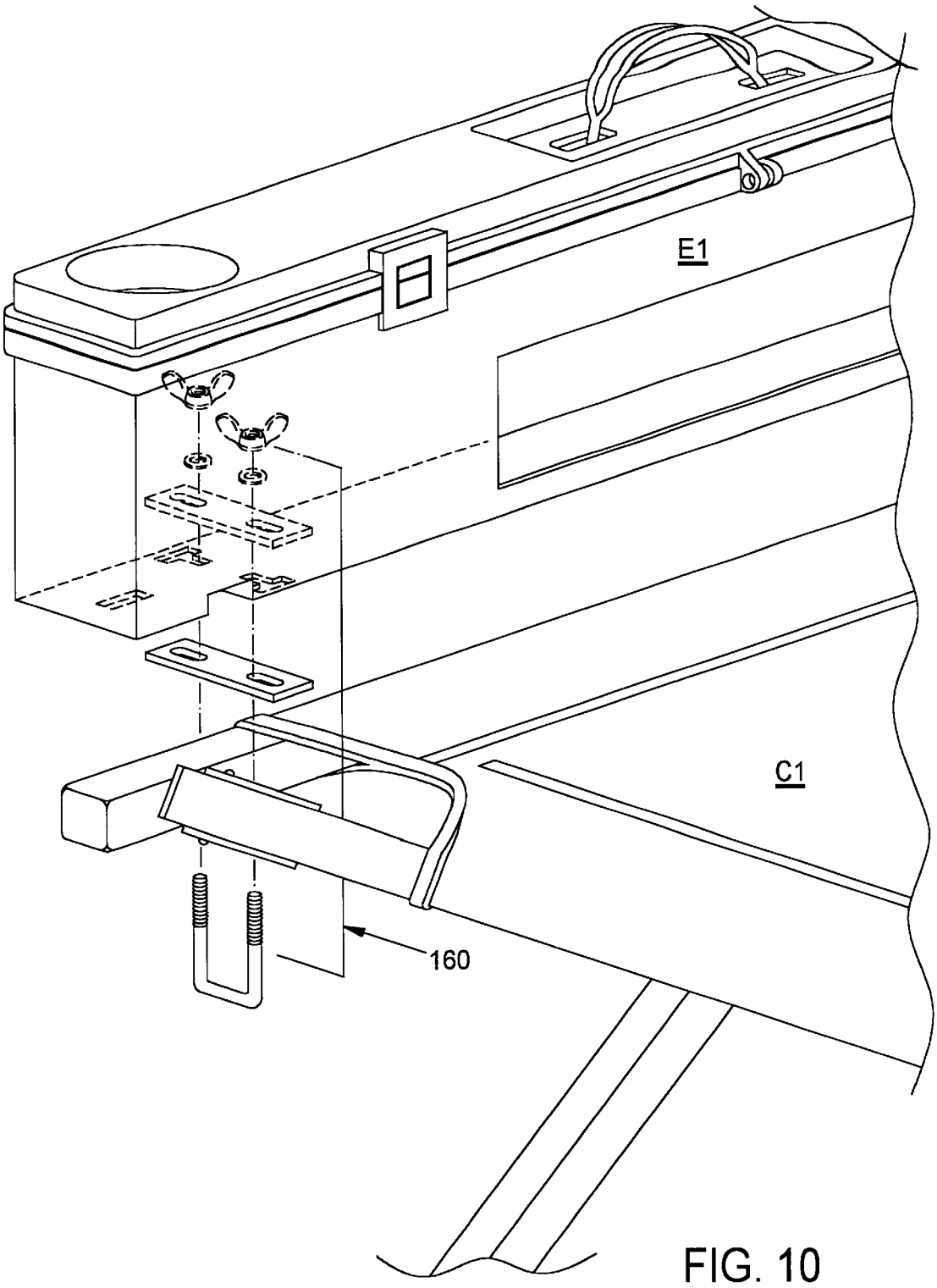
FIG. 10 is a front perspective transparent view from above of the preferred embodiment of the storage endboard in its first mounting application depicting the pre-attachment relationship between the right side of the endboard, the angular-frame U-bolt mounting bracket clamp assembly, and one corner of the type sleeping cot depicted in FIG. 8.

In FIG. 10 the right side of storage endboard E1, clamp assembly 160, and one comer of sleeping cot type C1 are juxtaposed in their pre-attachment relationships (opposite end of endboard E1 and opposite corner of cot type C1 correspond) (figure also applies to alternative embodiment of storage endboard E2).

Figure 11:
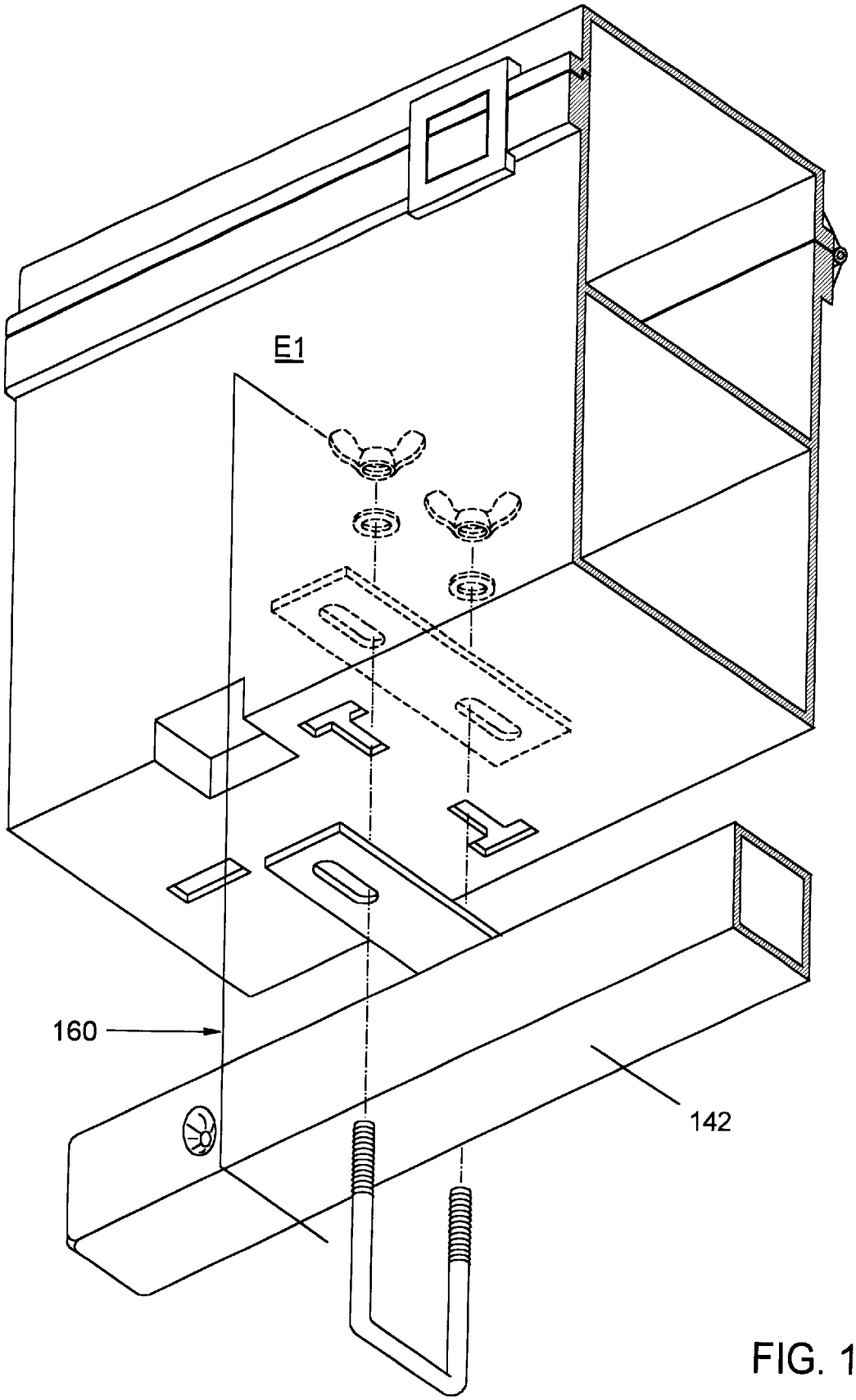
FIG. 11 is a front perspective sectional transparent view from below of the preferred embodiment of the storage endboard in its first mounting application depicting the pre-attachment relationship between the right side of endboard, the angular-frame U-bolt mounting bracket clamp assembly, and one end of one of the crossarms of the type sleeping cot depicted in FIG. 8.

In FIG. 11 the right side of storage endboard E1, clamp assembly 160, and one end of cot crossarm 142 are juxtaposed in their pre-attachment relationships (cot sleeping surface S1, siderail 144, leg 146, and end leg-support bracket 150 omitted for clarity) (opposite side of endboard E1 and opposite end of crossarm 142 correspond) (figure also applies to alternative embodiment of storage endboard E2).

Figure 12:
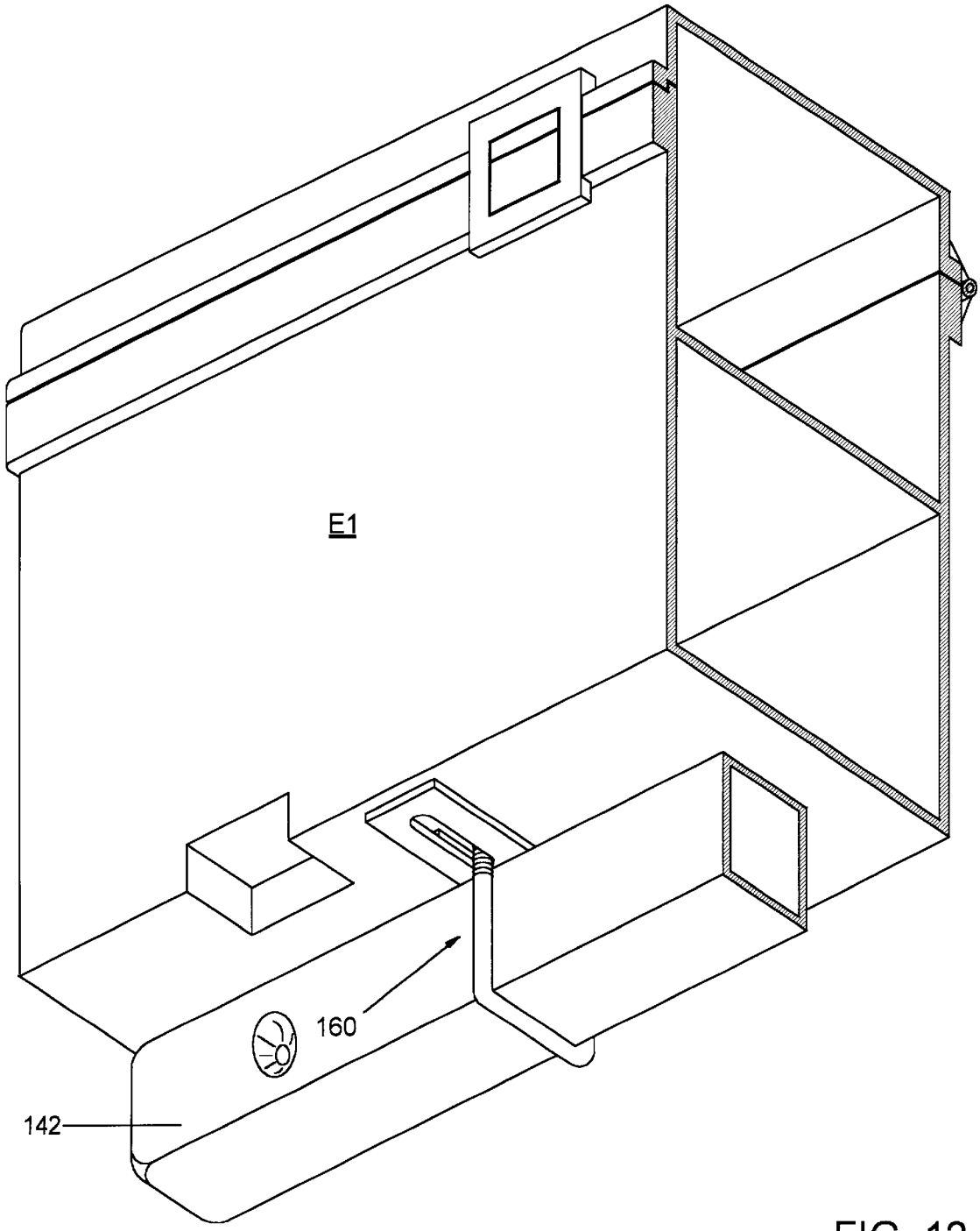
FIG. 12 is a front perspective sectional view from below of the preferred embodiment of the storage endboard in its first mounting application depicting the right side of the endboard attached to one end of one of the crossarms of the type sleeping cot depicted in FIG. 8 using the angular-frame U-bolt mounting bracket clamp assembly.

In FIG. 12 the right side of storage endboard E1 is attached to one end of cot crossarm 142 using clamp assembly 160 (cot sleeping surface S1, siderail 144, leg 146, and end leg-support bracket 150 omitted for clarity) (opposite side of endboard E1 and opposite end of crossarm 142 correspond) (figure also applies to alternative embodiment of storage endboard E2).

Figures 13A, 13B:
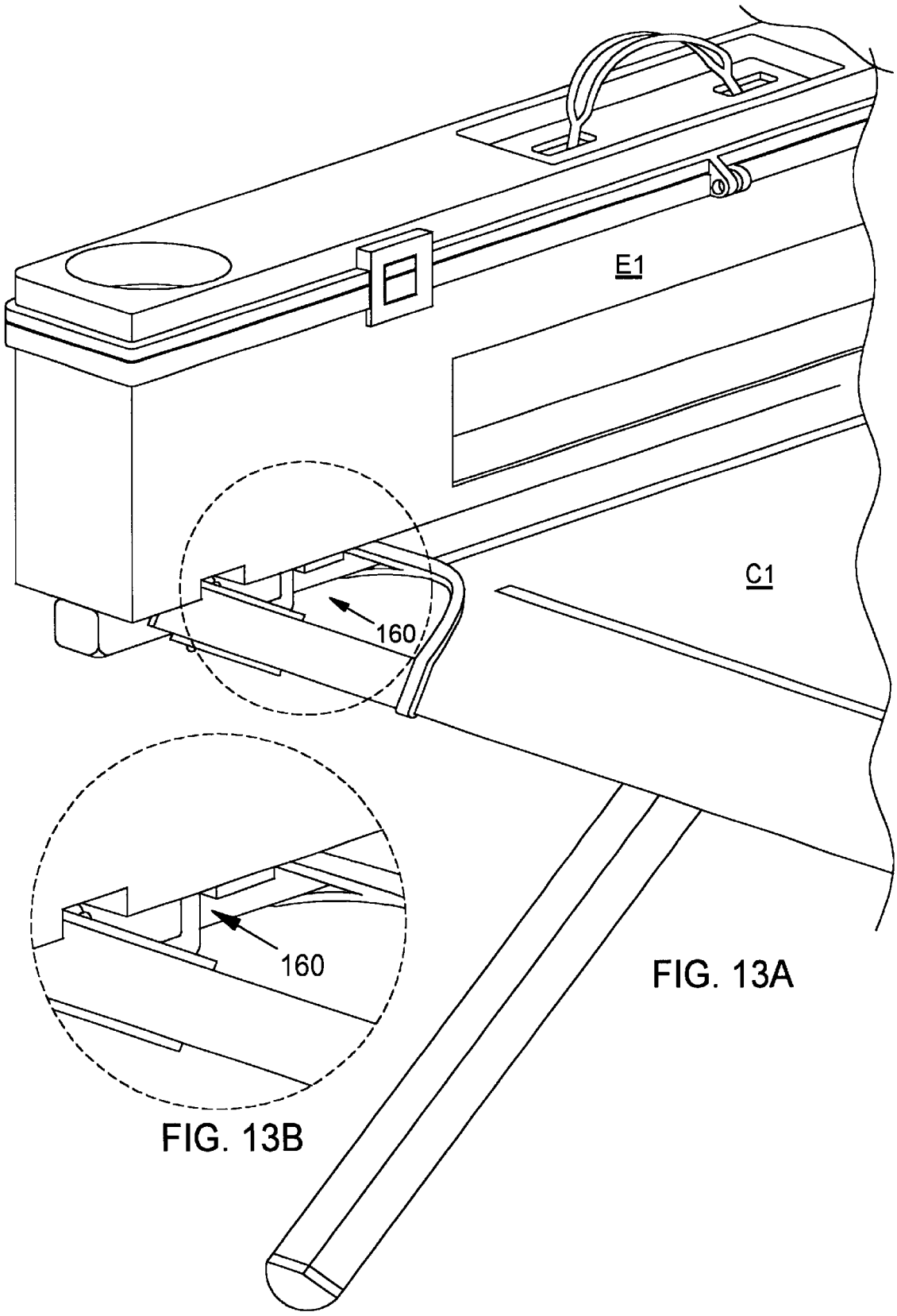
FIG. 13A is a front perspective view from above of the preferred embodiment of the storage endboard in its first mounting application depicting the right side of the endboard attached to one corner of the type sleeping cot depicted in FIG. 8 using the angular-frame U-bolt mounting bracket clamp assembly.
FIG. 13B is an enlarged front perspective view from above of the preferred embodiment of the storage endboard in its first mounting application detailing the right side of the endboard attached to one corner of the type sleeping cot depicted in FIG. 8 using the angular-frame U-bolt mounting bracket clamp assembly.

In FIGS. 13A–13B right side of storage endboard E1 is attached to one corner of sleeping cot type C1 using clamp assembly 160 (opposite side of endboard E1 and opposite corner of cot type C1 correspond) (figure also applies to alternative embodiment of storage endboard E2).

Figure 14:
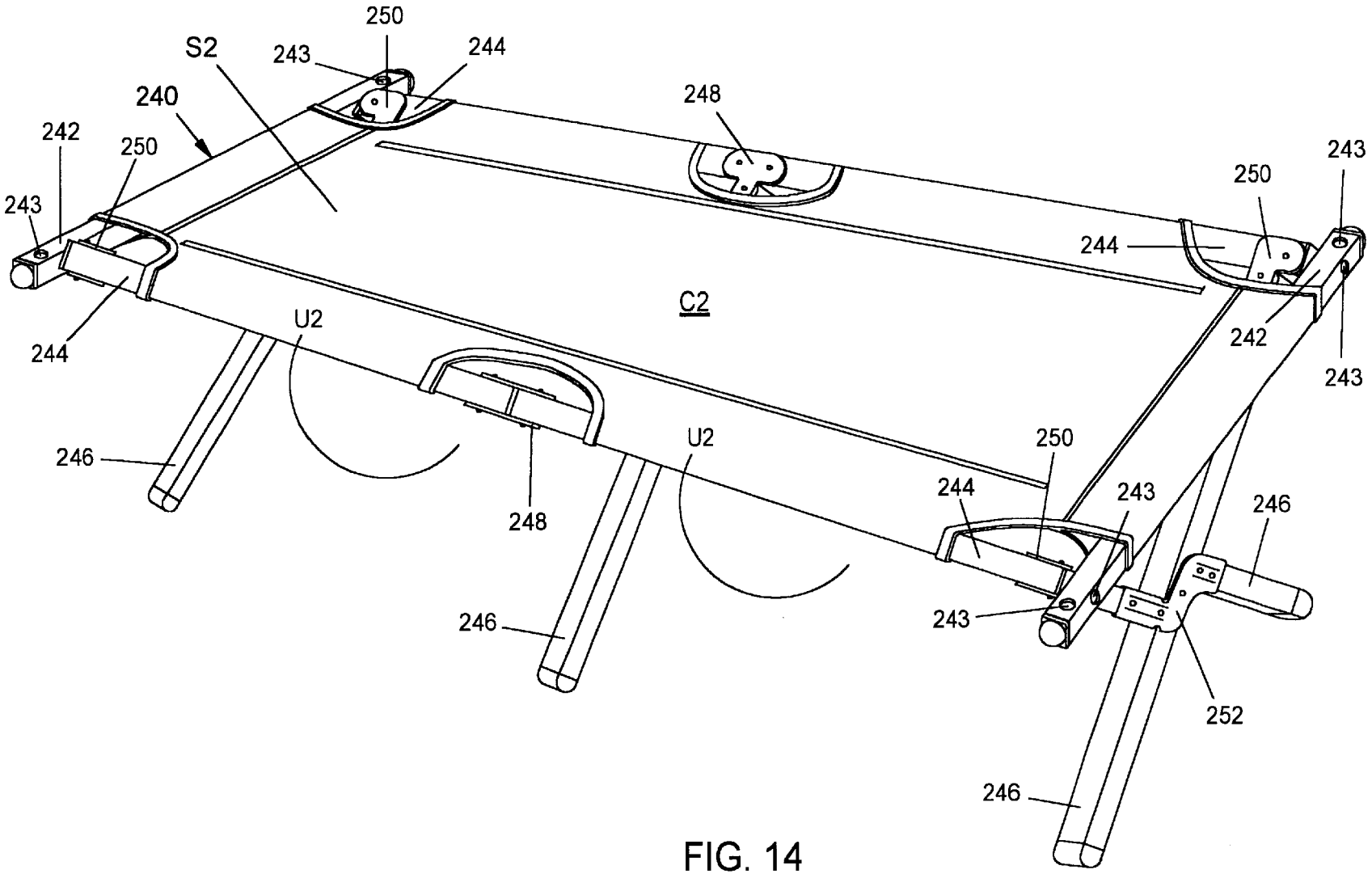
FIG. 14 PRIOR ART
FIG. 14 is a front perspective view from above depicting a prior-art sleeping cot of a general type with an angular frame used in a second mounting application of the preferred embodiment of the storage endboard for a sleeping cot.

FIGS. 14–19—Preferred Embodiment Endboard E1 and Sleeping Cot Type C2 in a Second Mounting Application In FIG. 14 a prior-art sleeping cot type C2 usually constructed of heavy gauge aluminum comprises a generally rectangular horizontally disposed fabric sleeping surface S2 supported by an angular frame 240 which is supported by a plurality of legs 246. Angular frame 240 comprises a plurality of crossarms 242 with a plurality of circular sleeping surface tensioning apertures 243 incorporated therein, and a plurality of adjoining siderails 244. Legs 246 are attached to siderails 244 by a center leg-support bracket 248 or an end leg-support bracket 250. Opposing legs 246 are attached to each other by a leg-connecting bracket 252. The area immediately beneath sleeping surface S2 comprises an underspace storage area U2.

Figure 15:
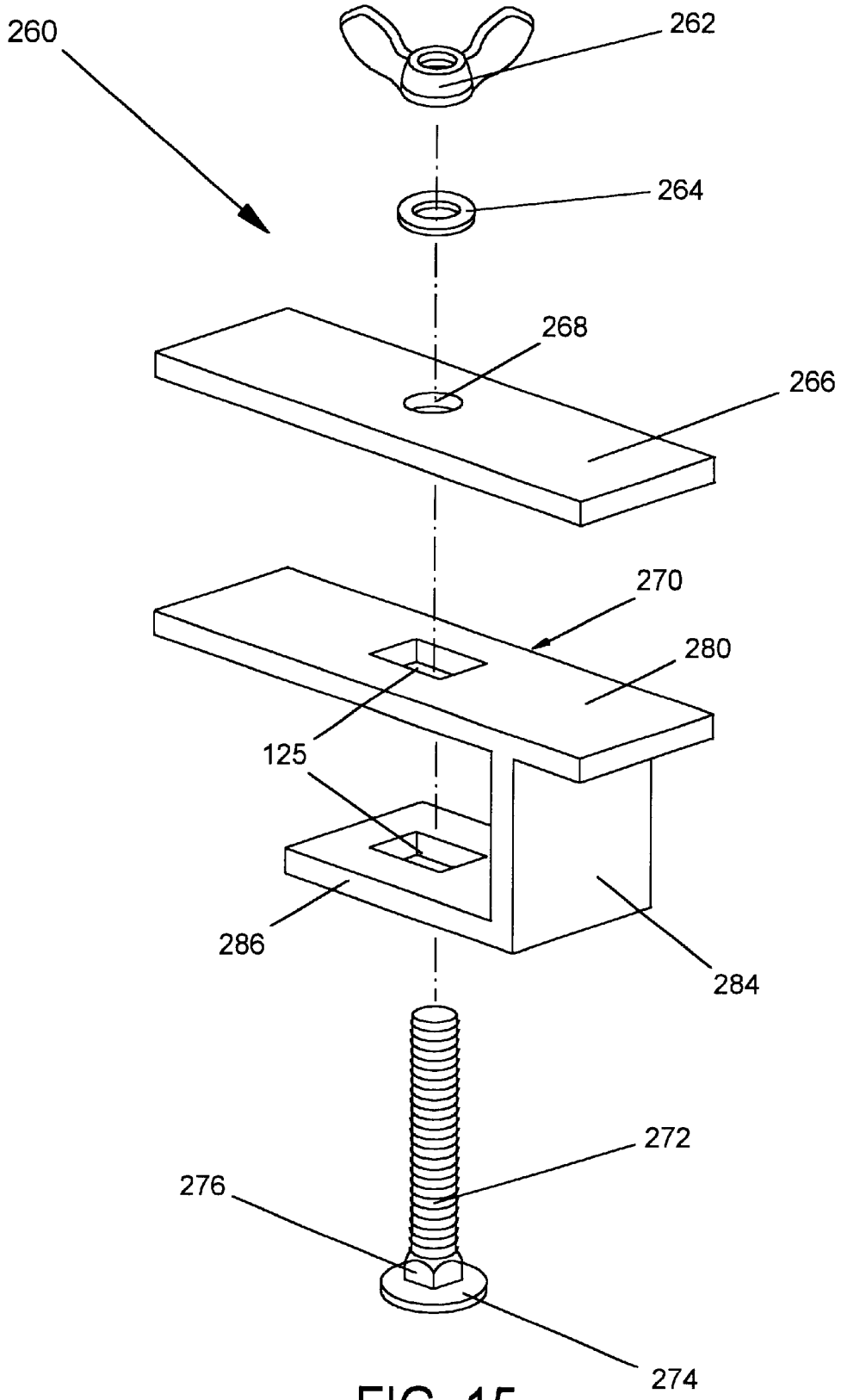
FIG. 15 is a front perspective view from above depicting the angular-frame arrester bracket mounting clamp assembly used in a second mounting application to attach the preferred embodiment of the storage endboard to the type sleeping cot depicted in FIG. 14.

In FIG. 15 an angular-frame arrester mounting bracket clamp assembly 260 comprises a of large wingnut 262, a large washer 264, a one-hole washer plate 266, an arrester mounting bracket 270 and a large mounting bolt 272. A large circular mounting bolt aperture 268 is centrally disposed to washer plate 266. Large mounting bolt 272 includes a head 274 with a square shank portion 276 adjacent thereto. Bracket 270 comprises a base plate 280, a vertical member 284, and a horizontal member 286. Large rectangular mounting bolt apertures 125 are centrally disposed to base plate 280 and horizontal member 286. Vertical member 284 projects downward perpendicularly from the lower surface of base plate 280 at a predetermined location outboard mounting bolt aperture 125 of base plate 280. Horizontal member 286 projects perpendicularly from the end of vertical member 284 paralleling base plate 280 inboard, toward mounting bolt aperture 125 centrally disposed to base plate 280. Mounting bolt aperture 125 centrally disposed to horizontal member 286 aligns vertically with mounting bolt aperture 125 centrally disposed to base plate 280.

Figure 16:
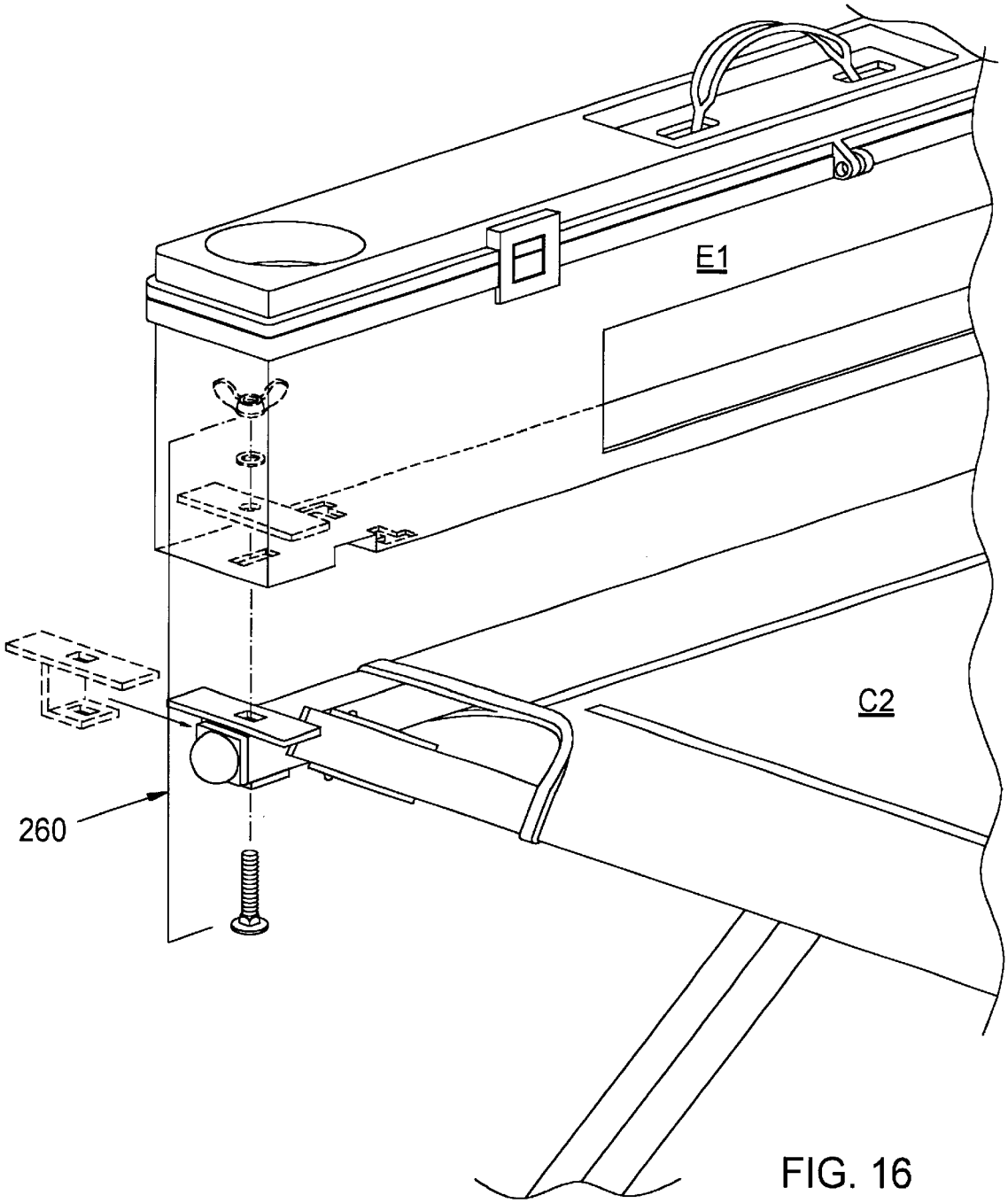
FIG. 16 is a front perspective transparent view from above of the preferred embodiment of the storage endboard in its second mounting application depicting the pre-attachment relationship between the right side of endboard, the angular-frame arrester bracket clamp assembly, and one comer of the type sleeping cot depicted in FIG. 14.

In FIG. 16 the right side of storage endboard E1, clamp assembly 260, and one comer of sleeping cot type C2 are juxtaposed in their pre-attachment relationships (opposite side of endboard E1 and opposite corner of cot type C2 correspond) (figure also applies to alternative embodiment of storage endboard E2).

Figure 17:
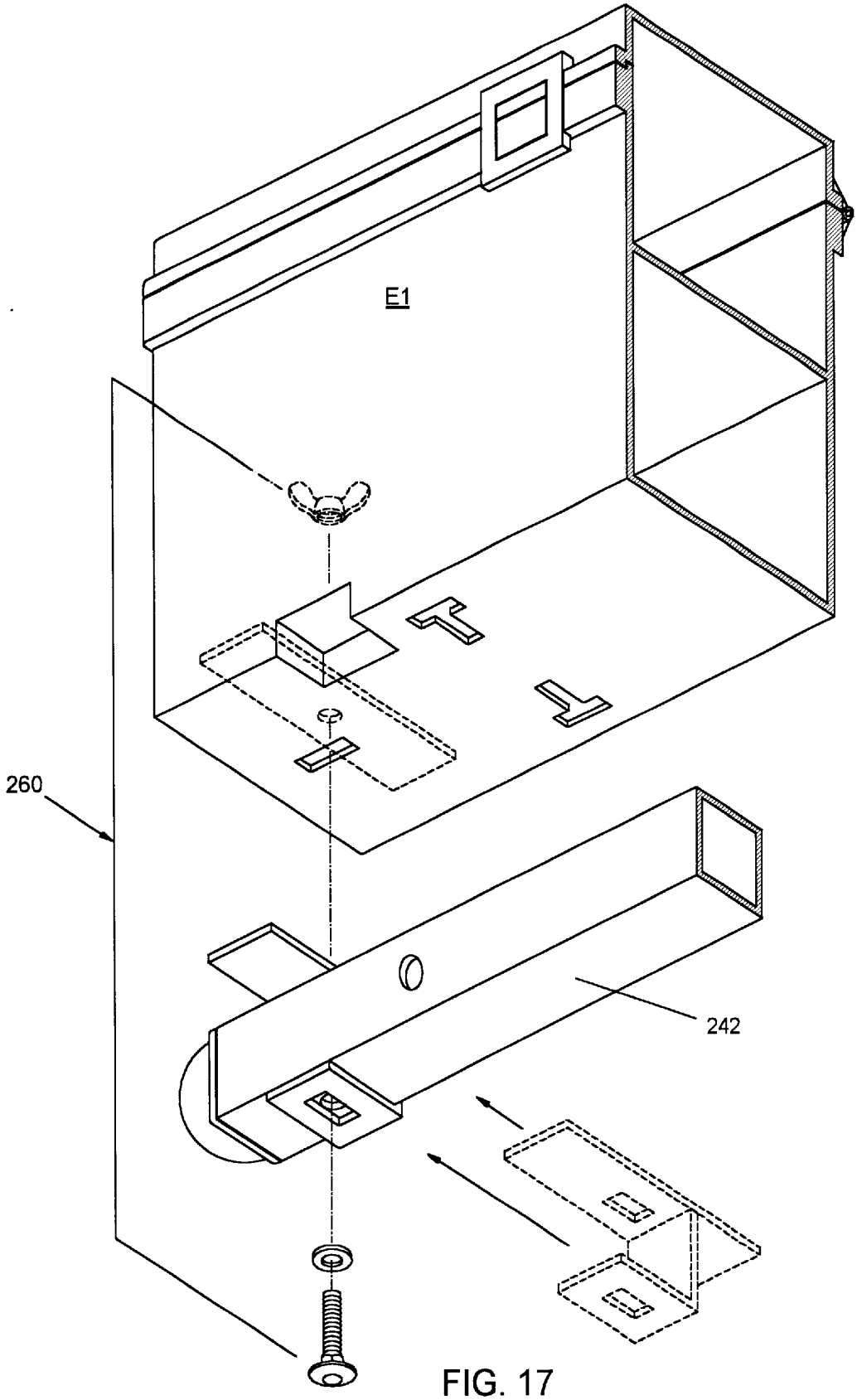
FIG. 17 is a front perspective sectional transparent view from below of the preferred embodiment of the storage endboard in its second mounting application depicting the pre-attachment relationship between the right side of the endboard, the angular-frame arrester bracket clamp assembly, and one end of one of the crossarms of the type sleeping cot depicted in FIG. 14.

In FIG. 17 the right side of storage endboard E1, clamp assembly 260, and one end of crossarm 242 are juxtaposed in their pre-attachment relationships (cot sleeping surface S2, siderail 244, leg 246, and end leg-support bracket 250 omitted for clarity) (opposite side of endboard E1 and opposite end of crossarm 242 correspond) (figure also applies to alternative embodiment of storage endboard E2).

Figure 18:
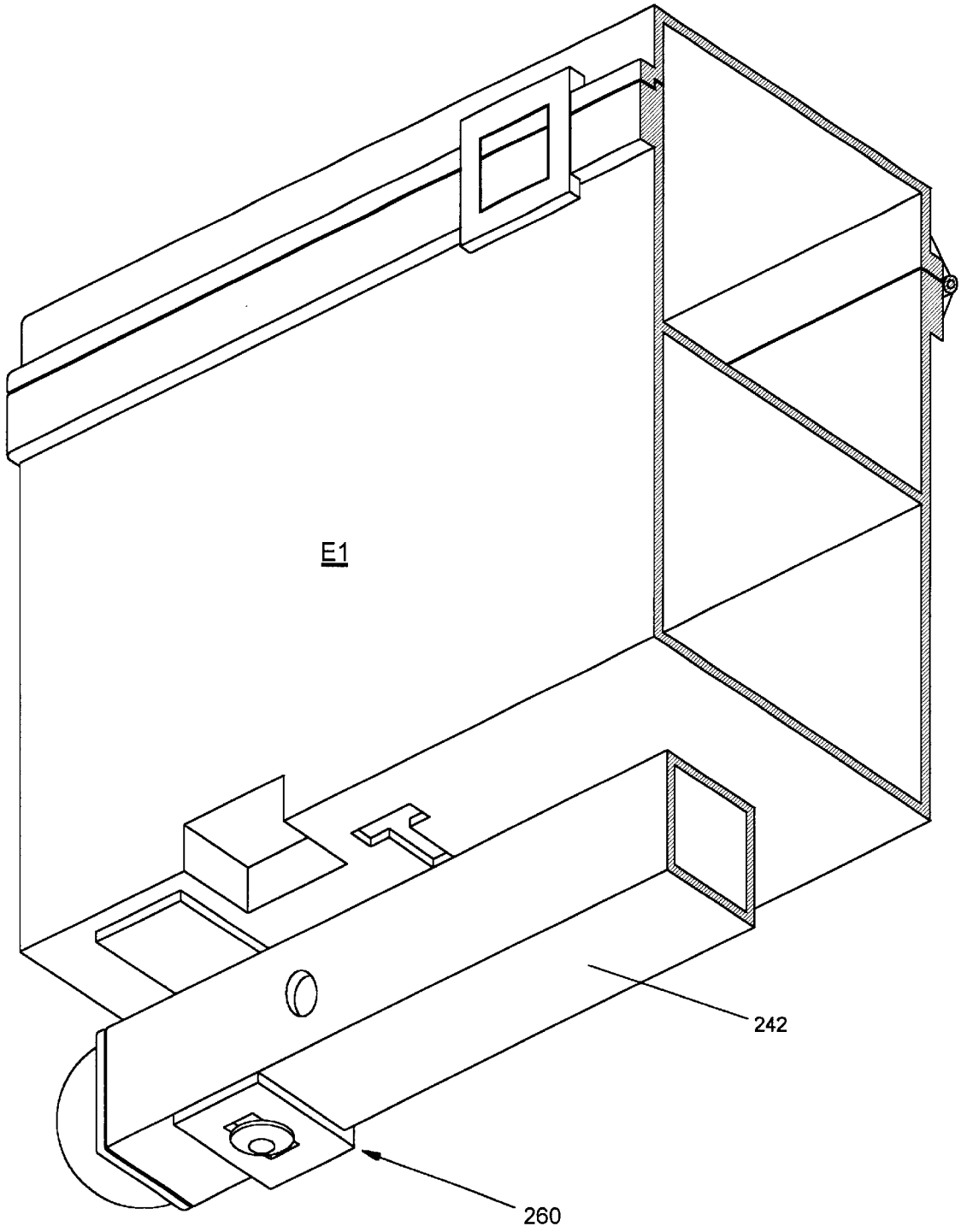
FIG. 18 is a front perspective sectional view from below of the preferred embodiment of the storage endboard in its second mounting application depicting the right side of the endboard attached to one end of one of the crossarms of the type sleeping cot depicted in FIG. 14 using the angular-frame arrester bracket mounting clamp assembly.

In FIG. 18 right side of storage endboard E1 is attached to one end of crossarm 242 using clamp assembly 260 (cot sleeping surface S2, siderail 244, leg 246, and end leg-support bracket 250 omitted for clarity) (opposite side of endboard E1 and opposite end of crossarm 242 correspond) (figure also applies to alternative embodiment of storage endboard E2).

Figures 19A, 19B:
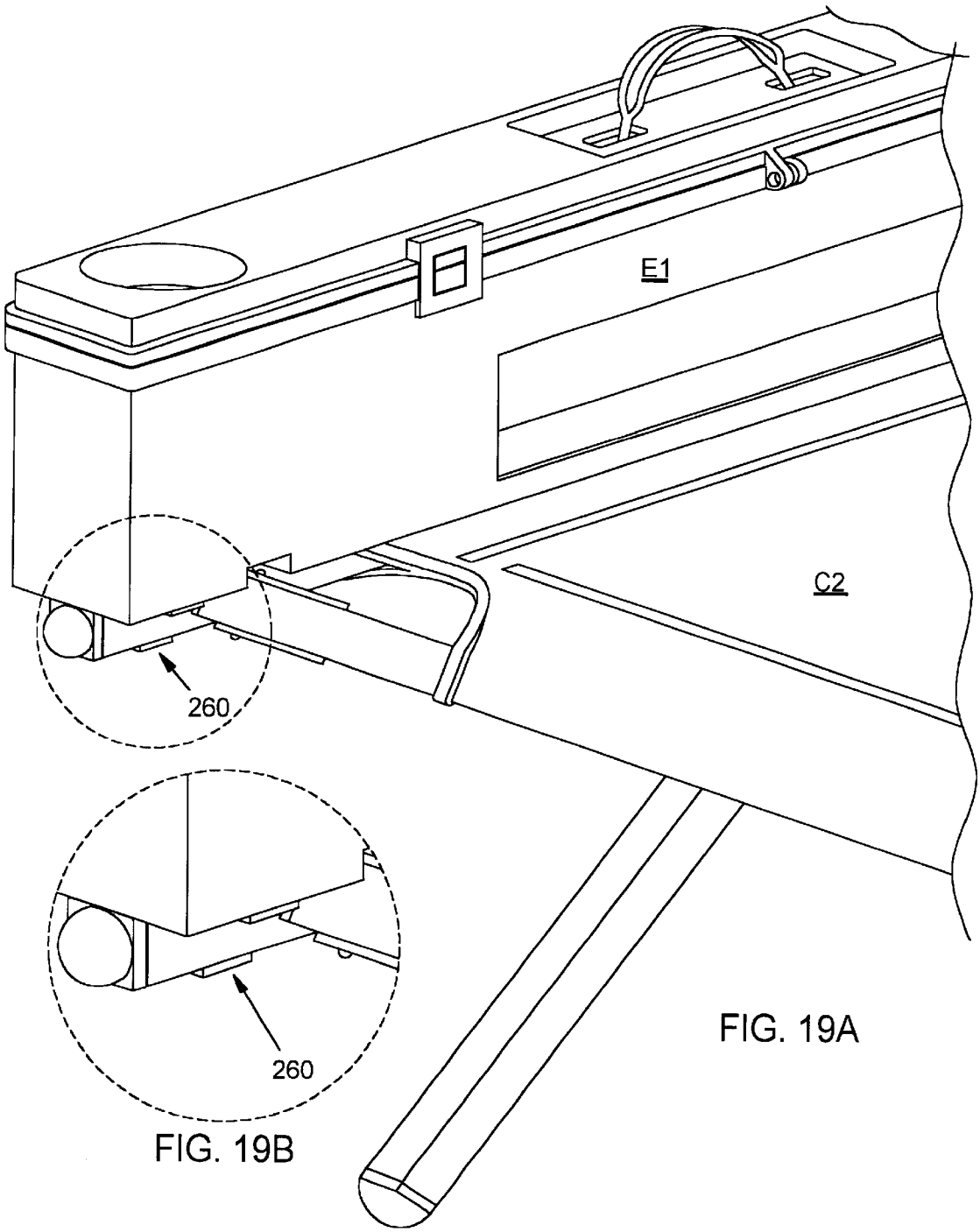
FIG. 19A is a front perspective view from above of the preferred embodiment of the storage endboard in its second mounting application depicting the right side of the endboard attached to one comer of the type sleeping cot depicted in FIG. 14 using the angular-frame arrester bracket mounting clamp assembly.
FIG. 19B is an enlarged front perspective view from above of the preferred embodiment of the storage endboard in its second mounting application detailing the right side of the endboard attached to one comer of the type sleeping cot depicted in FIG. 14 using the angular-frame arrester bracket mounting clamp assembly.

In FIGS. 19A–19B right side of storage endboard E1 is attached to one comer of sleeping cot type C2 using clamp assembly 260 (opposite side of endboard E1 and opposite corner of cot type C2 correspond) (figure also applies to alternative embodiment of storage endboard E2).

Figure 20:
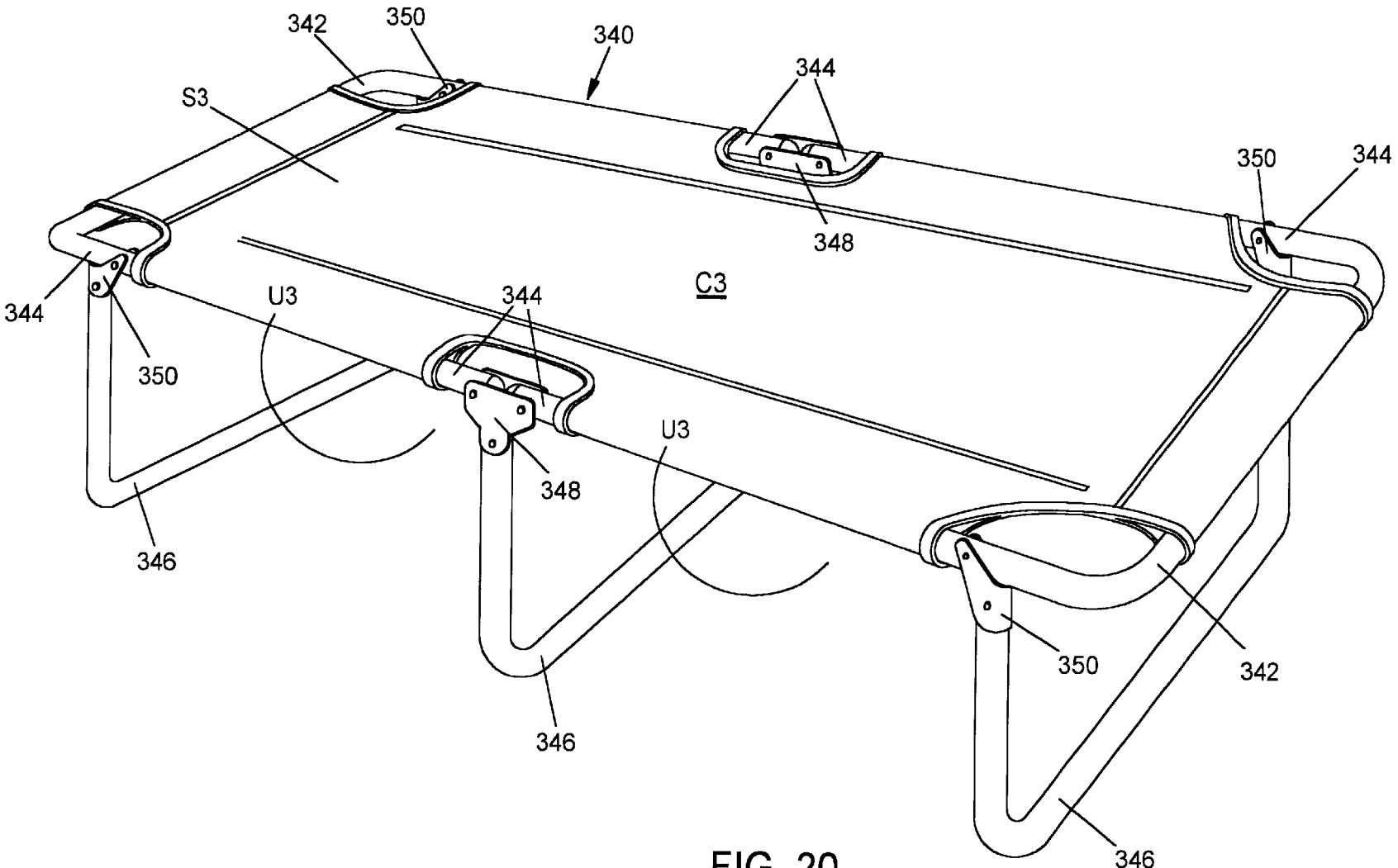
FIG. 20 PRIOR ART
FIG. 20 is a front perspective view from above depicting a prior-art sleeping cot of a general type with a tubular frame used in a third mounting application of the preferred embodiment of the storage endboard for a sleeping cot.

FIGS. 20–25—Preferred Embodiment Endboard E1 and Sleeping Cot Type C3 in a Third Mounting Application In FIG. 20 a prior-art sleeping cot type C3 usually constructed of aluminum comprises a generally rectangular horizontally disposed fabric sleeping surface S3 supported by a tubular frame 340 which is in turn supported by a plurality of tubular legs 346. Tubular frame 340 comprises a plurality of crossarms 342 and a plurality of adjoining siderails 344. Legs 346 are attached to siderails 344 by a center leg-support bracket 348 or an end leg-support bracket 350. The area immediately beneath sleeping surface S3 comprises an underspace storage area U3.

Figure 21:
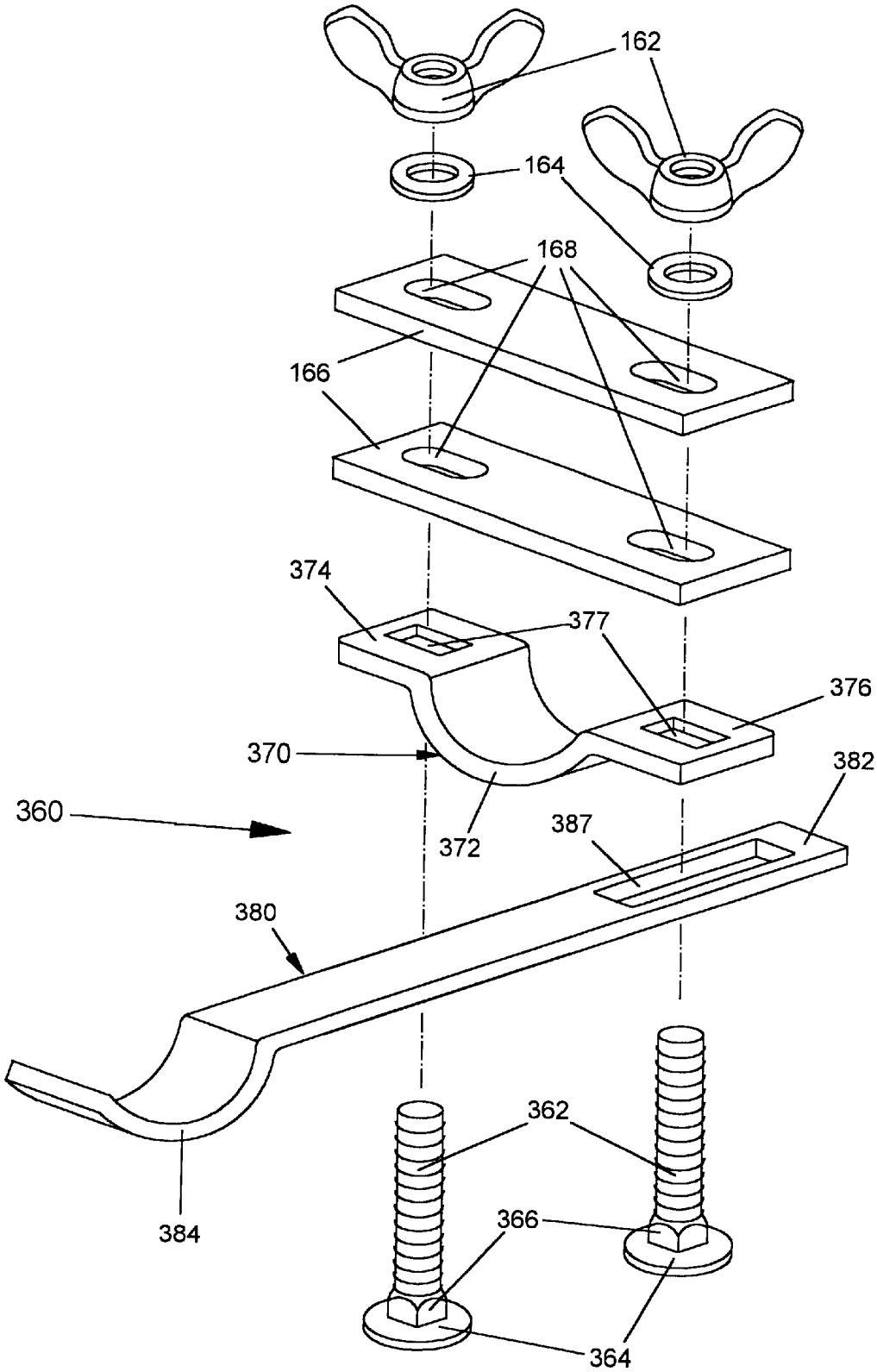
FIG. 21 is a front perspective view from above depicting a tubular-frame anti-roll mounting bracket clamp assembly used in a third mounting application to attached the preferred and alternative embodiments of the storage endboard for a sleeping cot to the type sleeping cot depicted in FIG. 20.

In FIG. 21 a tubular-frame anti-roll mounting bracket clamp assembly 360 includes small wingnuts 162, small washers 164, two-hole washer plates 166, an anti-roll mounting bracket 370, a plurality of small mounting bolts 362, and an anti-roll outrigger 380. Elongated small mounting bolt apertures 168 are disposed to predetermined positions at each end of washer plates 166. Each small mounting bolt 362 includes a head 364 with a square shank portion 366 adjacent thereto. Bracket 370 comprises an elongated single piece of metal shaped to form a curved base 372 flanked by a left horizontal arm member 374 and a right horizontal arm member 376. A small rectangular mounting bolt aperture 377 is centrally disposed to horizontal arm members 374 and 376. Anti-roll outrigger 380 comprises an elongated piece of metal with a flat end 382 and a crooked end 384. An elongated small rectangular mounting bolt aperture 387 is disposed to a predetermined position on flat end 382 of outrigger 380

Figure 22:
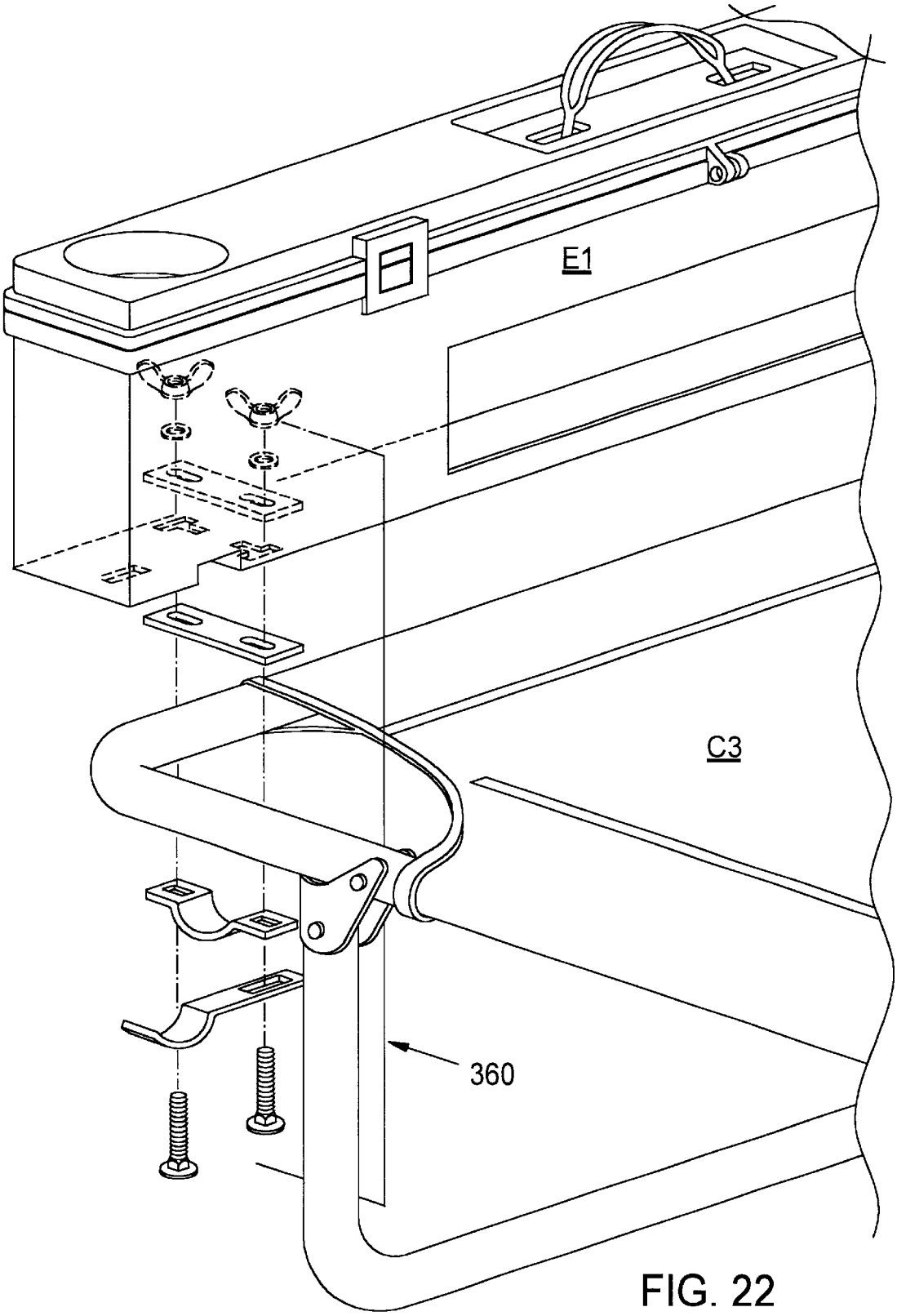
FIG. 22 is a front perspective transparent view from above of the preferred embodiment of the storage endboard in a third mounting application depicting the pre-attachment relationship between the right side of the endboard, the tubular-frame anti-roll mounting bracket clamp assembly, and one corner of the type sleeping cot depicted in FIG. 20.

In FIG. 22 the right side of storage endboard E1, clamp assembly 360, and one corner of sleeping cot type C3 are juxtaposed in their pre-attachment relationships (opposite side of endboard E1 and opposite corner of cot type C3 correspond) (figure also applies to alternative embodiment of storage endboard E2).

Figure 23:
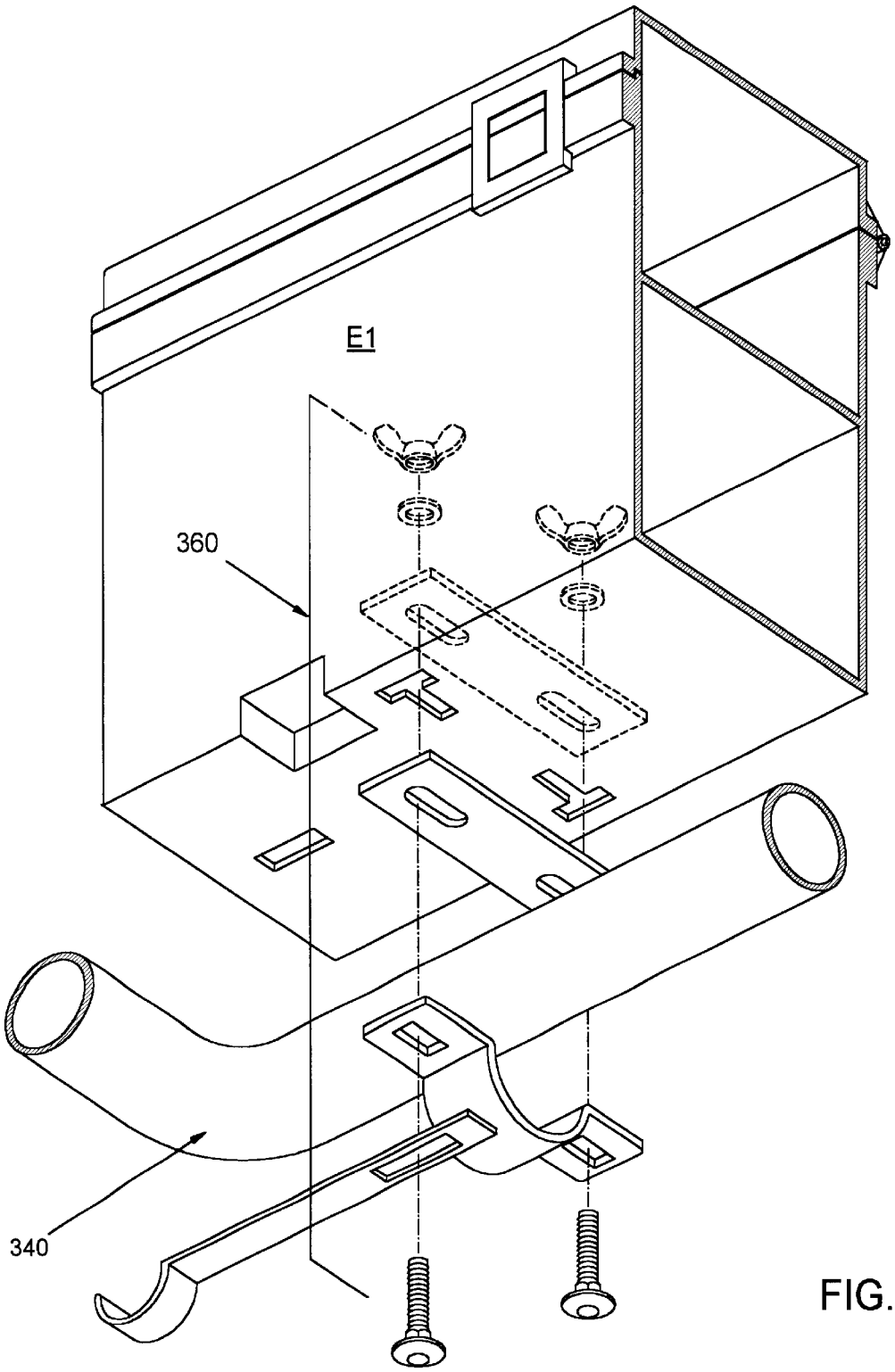
FIG. 23 is a front perspective sectional transparent view from below of the preferred embodiment of the storage endboard in a third mounting application depicting the pre-attachment relationship between the right side of the endboard, the tubular-frame anti-roll mounting bracket clamp assembly, and one comer of the frame of the type sleeping cot depicted in FIG. 20.

In FIG. 23 the right side of storage endboard E1, clamp assembly 360, and one corner of frame 340 are juxtaposed in their pre-attachment relationships (cot sleeping surface S3, leg 346, and end leg-support bracket 350 omitted for clarity) (opposite side of endboard E1 and opposite corner of frame 340 correspond) (figure also applies to alternative embodiment of storage endboard E2).

Figure 24:
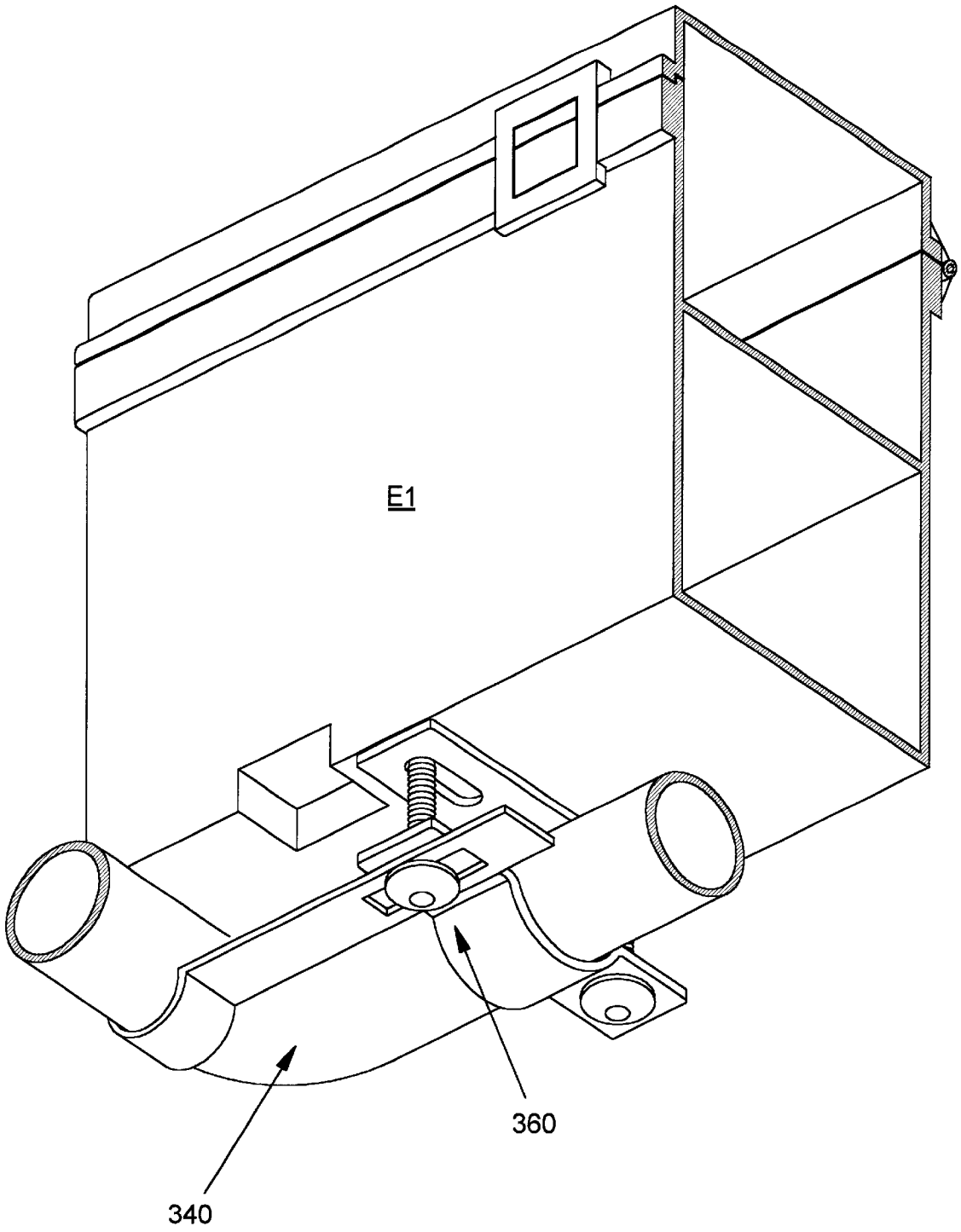
FIG. 24 is a front perspective sectional view from below of the preferred embodiment of the storage endboard in a third mounting application depicting the right side of the endboard attached to one comer of the frame of the type sleeping cot depicted in FIG. 20 using the tubular-frame anti-roll mounting bracket clamp assembly.

In FIG. 24 the right side of storage endboard E1 is attached to one corner of frame 340 using clamp assembly 360 (cot sleeping surface S3, leg 346, and end leg-support bracket 350 omitted for clarity) (opposite side of endboard E1 and opposite corner of frame 340 correspond) (figure also applies to alternative embodiment of storage endboard E2).

Figures 25A, 25B:
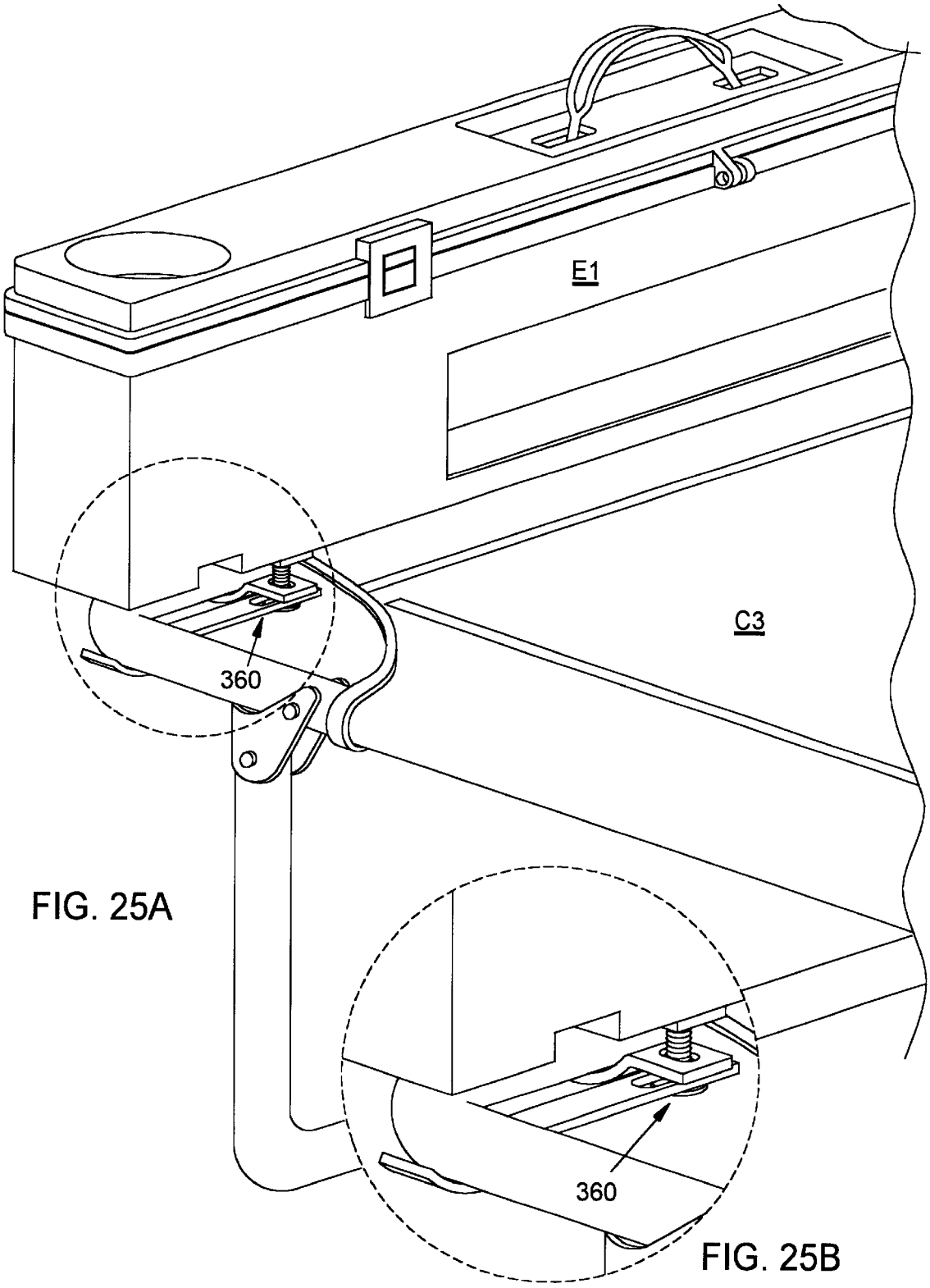
FIG. 25A is a front perspective view from above of the preferred embodiment of the storage endboard in a third application depicting the right side of the endboard attached to one comer of the type sleeping cot depicted in FIG. 20 using the tubular-frame anti-roll mounting bracket clamp assembly.
FIG. 25B is an enlarged front perspective view from above of the preferred embodiment of the storage endboard in a third mounting application detailing the right side of the endboard attached to one corner of the frame of the type sleeping cot depicted in FIG. 20 using the tubular-frame anti-roll mounting bracket clamp assembly.

In FIGS. 25A–25B right side of storage endboard E1 is attached to sleeping cot type C3 using clamp assembly 360 (opposite side of endboard E1 and opposite corner of cot type C3 correspond) (figure also applies to alternative embodiment of storage endboard E2).

Figure 26A:
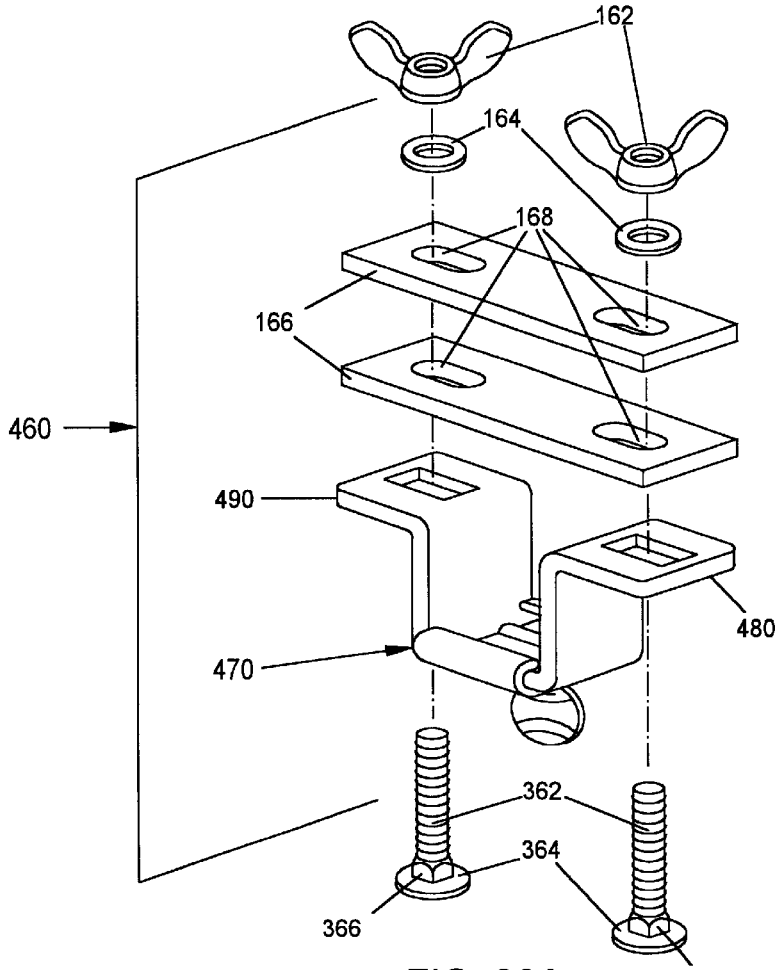
FIG. 26A is a front perspective view from above depicting an angular-frame adjustable mounting bracket clamp assembly used in a fourth mounting application to attach the preferred embodiment of the storage endboard to the type sleeping cot depicted in FIG. 8.
Figure 26B:
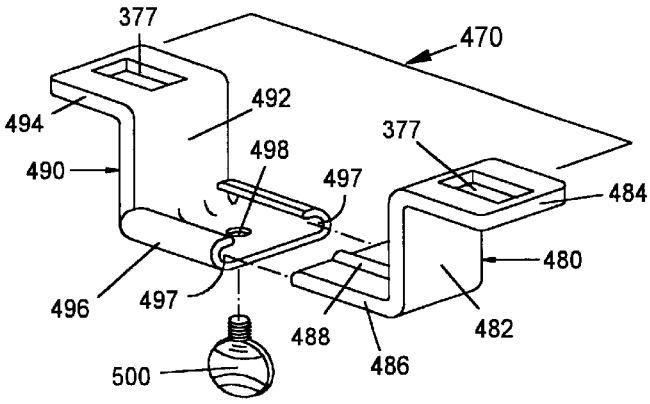
FIG. 26B is a front perspective view from above depicting the adjustable components of the adjustable mounting bracket clamp assembly depicted in FIG. 26A.
Figure 26C:
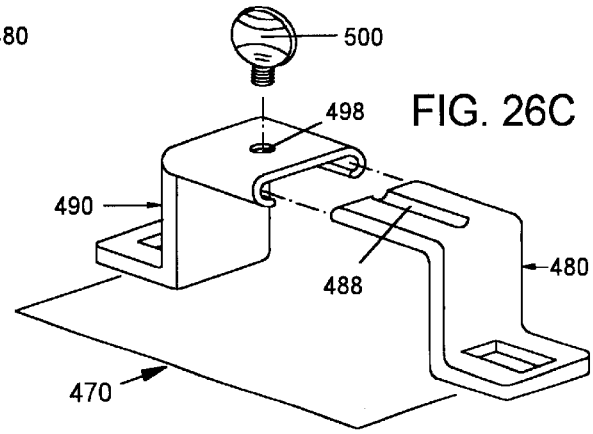
FIG. 26C is an inverted view of FIG. 26B.

FIGS. 26–30—Preferred Embodiment Endboard E1 and Sleeping Cot Type C1 in a Fourth Mounting Application In FIGS. 26A–26C an angular-frame adjustable mounting bracket clamp assembly 460 comprises small wingnuts 162, small washers 164, two-hole washer plates 166, an adjustable mounting bracket 470, and small mounting bolts 362. Elongated small mounting bolt apertures 168 are disposed to predetermined positions at each end of washer plates 166. Each small mounting bolt 362 comprises head 364 with square shank portion 366 adjacent thereto. Mounting bracket 470 comprises a male bracket component 480 and a female bracket component 490.

Male bracket component 480 comprises an elongated piece of metal shaped to form a vertical male trunk member 482, an upper horizontal male arm member 484 and a lower horizontal male arm member 486. Arm members 484 and 486 are perpendicularly disposed to opposite ends of trunk member 482 and extend in opposite directions away from their transitional joints therewith. Small rectangular mounting bolt aperture 377 is centrally disposed to upper horizontal male arm member 484. And an elongated thumbscrew drag slot 488 is centrally disposed to lower horizontal male arm member 486. Drag slot 488 faces downwards, away from trunk member 482, and runs parallel to the side edges of arm member 486.

Mating female bracket component 490 comprises an elongated piece of metal shaped to form a vertical female trunk member 492, an upper horizontal female arm member 494, and a lower horizontal female arm member 496. Arm members 494 and 496 are perpendicularly disposed to opposite ends of trunk member 492 and extend in opposite directions away from their transitional joints therewith. Small rectangular mounting bolt aperture 377 is centrally disposed to upper horizontal female arm member 494. The two parallel edges of female arm member 496 are folded back over the upper surface thereof to define a plurality of facing guide channels 497 which slidably receive lower horizontal male arm member 496 of male bracket component 480. A threaded aperture 498 is centrally disposed to lower horizontal female arm member 496 to threadedly receive a retaining thumbscrew 500.

To assemble bracket 470, position male bracket component 480 such that its arm member 486 is on a horizontal plane with dragslot 488 facing downwards. Then position female bracket component 490 opposite male bracket component 480 such that its arm member 496 is on a horizontal plane facing male arm member 486 with its guide channels 497 facing upwards. Slide male arm member 486 into slot formed by guide channels 497 in female arm member 496 far enough to cover threaded aperture 498. Thread thumbscrew 500 into threaded aperture 498 of female arm member 496 until thumbscrew 500 impacts inserted male arm member 486 and tighten enough to retain male arm member 486 in place.

Figure 27:
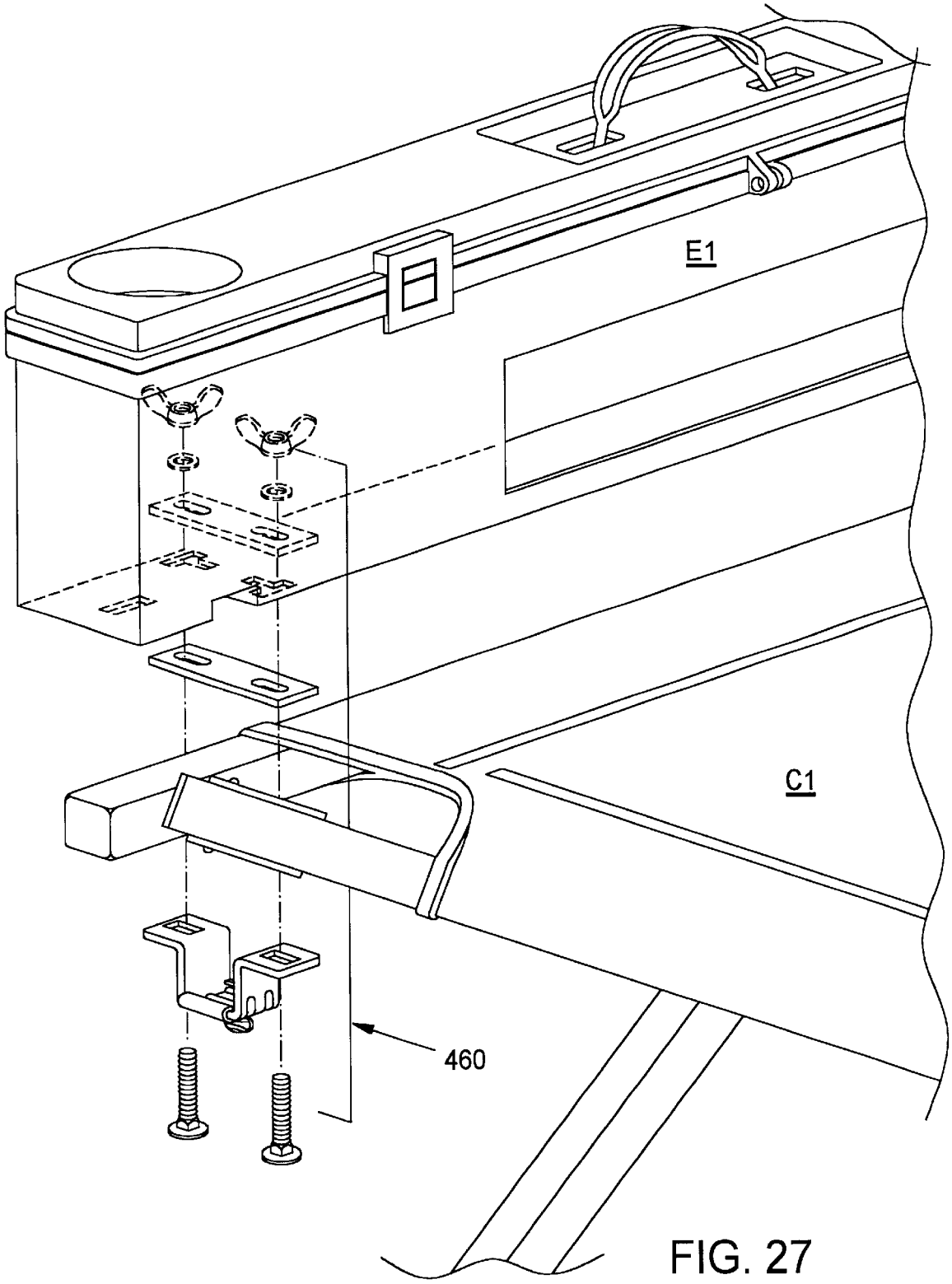
FIG. 27 is a front perspective transparent view from above of the preferred embodiment of the storage endboard in a fourth mounting application depicting the pre-attachment relationship between the right side of the endboard, the angular-frame adjustable mounting bracket clamp assembly, and one comer of the type sleeping cot depicted in FIG. 8.

In FIG. 27 the right side of storage endboard E1, clamp assembly 460, and one corner of sleeping cot type C1 are juxtaposed in their pre-attachment relationships (opposite end of endboard E1 and opposite corner of cot type C1 correspond) (figure also applies to alternative embodiment of storage endboard E2).

Figure 28:
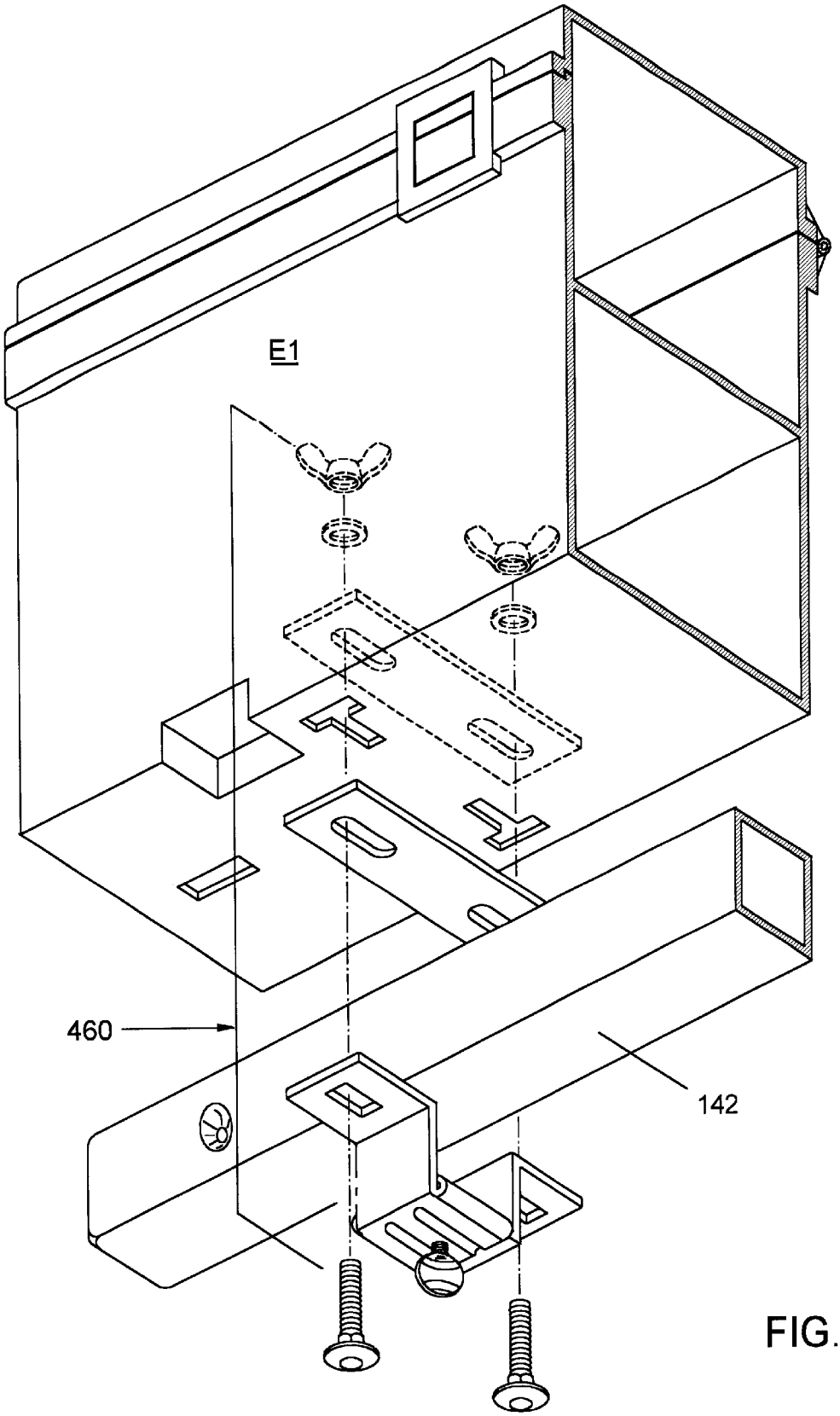
FIG. 28 is a front perspective sectional transparent view from below of the preferred embodiment of the storage endboard in a fourth mounting application depicting the pre-attachment relationship between the right side of endboard, the adjustable angular-frame mounting bracket clamp assembly, and one end of one of the crossarms of the type sleeping cot depicted in FIG. 8.

In FIG. 28 the right side of storage endboard E1, clamp assembly 460, and one end of cot crossarm 142 are juxtaposed in their pre-attachment relationships (cot sleeping surface S1, siderail 144, leg 146, and end leg-support bracket 150 omitted for clarity) (opposite side of endboard E1 and opposite end of crossarm 142 correspond) (figure also applies to alternative embodiment of storage endboard E2).

Figure 29:
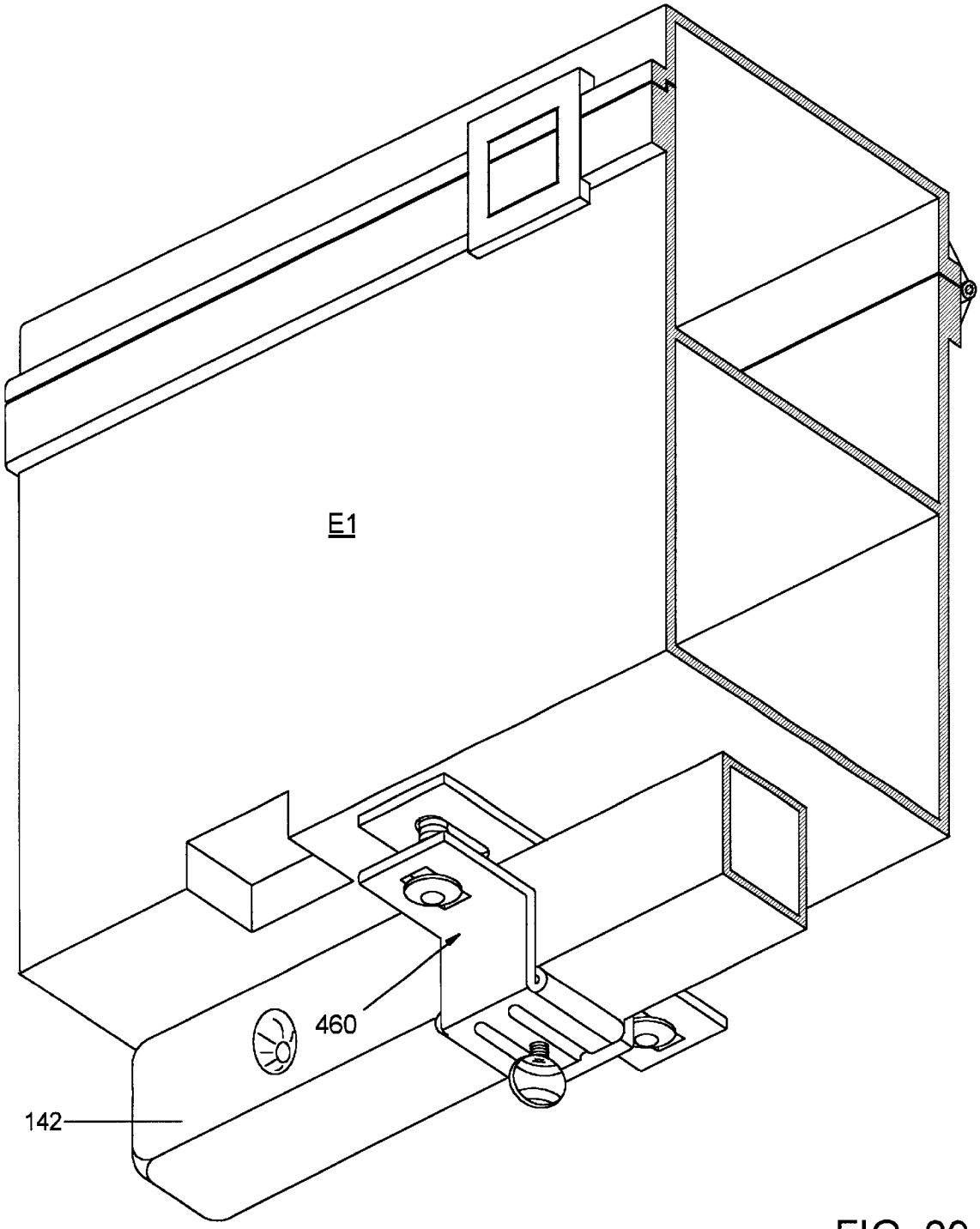
FIG. 29 is a front perspective sectional view from below of the preferred embodiment of the storage endboard in a fourth application depicting the right side of the endboard attached to one end of one of the crossarms of the type sleeping cot depicted in FIG. 8 using the angular-frame adjustable mounting bracket clamp assembly.

In FIG. 29 the right side of storage endboard E1 is attached to one end of cot crossarm 142 using clamp assembly 460 (cot sleeping surface S1, siderail 144, leg 146, and end leg-support bracket 150 omitted for clarity) (opposite side of endboard E1 and opposite end of crossarm 142 correspond) (figure also applies to alternative embodiment of storage endboard E2).

Figures 30A, 30B:
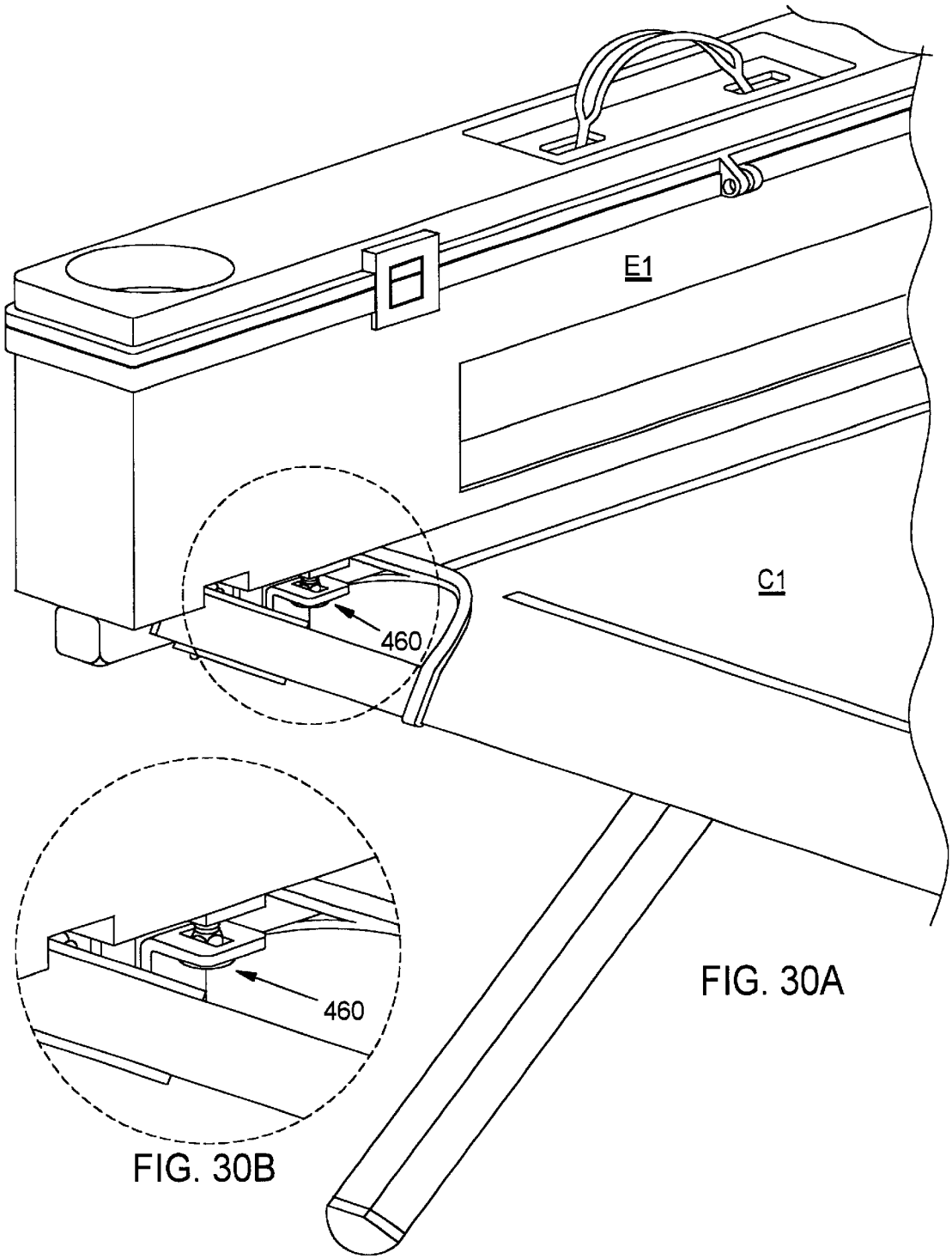
FIG. 30A is a front perspective view from above of the preferred embodiment of the storage endboard in a fourth mounting application depicting the right side of the endboard attached to one corner of the type sleeping cot depicted in FIG. 8 using the angular-frame adjustable mounting bracket clamp assembly.
FIG. 30B is an enlarged front perspective view from above of the preferred embodiment of the storage endboard in a fourth mounting application detailing the right side of the endboard attached to one comer of the frame of the type sleeping cot depicted in FIG. 8 using the angular-frame adjustable mounting bracket clamp assembly.

In FIGS. 30A–30B right side of storage endboard E1 is attached to one corner of sleeping cot type C1 using clamp assembly 460 (opposite side of endboard E1 and opposite corner of cot type C1 correspond) (figure also applies to alternative embodiment of storage endboard E2).

Advantages

From the description above a number of advantages of my storage endboard for a sleeping cot become evident:

(a) proximate and organized storage is provided for the myriad articles key to the welfare of personnel subsisting under field conditions in cot-based sleeping environments such as camping, military bivouac, and short or long term temporary emergency sheltering. Typically these articles are fragile and/or valuable and include but are not limited to eyeglasses, flashlights, cellphones, beepers, cameras, wallets, money clips, watches, jewelry, keys, medicines, and, in some cases, small personal defense weapons.

(b) placement of the storage endboard for a sleeping cot at either end of the sleeping cot allows the aforementioned articles to be stored in one close-at-hand location from which they may be easily and quickly retrieved when needed. This is especially important in a cot-based sleeping environment where power for electric lights is typically unavailable or not readily accessible. For example when used as a headboard in a camping environment, eyeglasses and flashlight stored in the endboard's front-facing externally-accessed storage compartment can be quickly and easily retrieved in the dark. This can facilitate a trip to the latrine or the investigation of the seemingly unending string of things that go "bump" in the night while camping.

(c) unlike other prior-art attempts at providing storage of articles on a sleeping cot, the endboard's interior storage and lockability features provide a measure of security from damage to and/or theft of the aforementioned articles. For the endboard is secured to the sleeping cot in a manner which, when its lid is closed and locked, precludes its removal from either inside or outside the endboard. Inside the endboard, the wingnuts, which hold their corresponding mounting clamp assemblies in place, are rendered inaccessible by the latched and locked lid of the endboard. Outside the endboard, the mounting bolts cannot be unscrewed because of the tight fit of their square shanks into rectangular apertures in corresponding mounting clamp assemblies. So when a mounting clamp assembly is secured to the sleeping cot and endboard, and the endboard is locked closed, the mounting clamp assembly cannot be loosened or removed from the endboard without structural damage to either the endboard or the cot.

(d) also unlike other prior-art attempts at providing storage of articles on a sleeping cot, the endboard will not interfere with fluid access to the cot's sleeping surface. That is, a person will not have to first attempt to sit on the cot's sleeping surface while trying to avoid damaging or upsetting articles stored in a contrivance such as the previously mentioned prior-art canvas fabric organizer hanging over the side of the cot. Then have to swing his or her legs over the organizer, again avoiding the stored articles, up onto the cot's sleeping surface. Nor will the endboard interfere with access to the cot's underspace storage area as does the canvas fabric organizer. And finally, use of the endboard does not require special placement of the cot away from the shelter wall as may be required with use of either the canvas fabric organizer or the previously mentioned prior-art cot rack.

(e) also unlike the previously mentioned cot rack and canvas fabric organizer which must be emptied before they can be moved, the endboard can be transported with articles stored securely in its interior storage compartments.

(f) also unlike prior-art attempts to provide storage of articles on a sleeping cot, the endboard, when used as a headboard, will retain a pillow in place at the head of the sleeping cot. Thus eliminating one of the most bothersome occurrences associated with use of a sleeping cot, i.e. inadvertently pushing the pillow off the cot in one's sleep (g) also unlike prior-art attempts to provide storage of articles on a sleeping cot, the endboard, in its alternative embodiment, can be used as a console to house convenience and safety amenities such as a reading light, weather radio, and digital alarm clock.

Operation

FIGS. 3–5, 8–13—First Mounting Application: Preferred Embodiment Endboard E1 and Sleeping Cot Type C1

The first step of this two-part operation entails mounting storage endboard E1 to angular-frame sleeping cot type C1 using angular-frame U-bolt mounting bracket clamp assembly 160. The second step entails locking mating lid 80 of endboard E1 to container 60 of endboard E1. Although not referenced herein, the method and apparatus described also apply to alternative embodiment storage endboard E2.

Mounting of storage endboard E1 to cot type C1 using clamp assembly 160 is effected as follows. Lay one two-hole washer plate 166 perpendicularly centered on the upper surface of each end of cot crossarm 142 in the uncovered portion of crossarm 142 that lies between its joint with siderail 144 and cot sleeping surface S1. Crossarm 142 at either end of cot type C1 may be used. With washer plate 166 in place at both ends of crossarm 142, place endboard E1 atop washer plates 166 with its externally accessed storage compartment 72 facing inboard, toward center of cot type C1, such that small T-shaped mounting bolt apertures 124 in bottom 62 of endboard E1 align with elongated small mounting bolt apertures 168 in washer plates 166. Also, align cot siderail clearance housings 106 in bottom 62 of endboard E1 with siderails 144 of cot type C1 which protrude above upper surface of crossarm 142. With endboard E1 in place, open lid 80 and reach inside end internally-accessed storage compartments 122 to place one washer plate 166 over mounting bolt apertures 124 in bottom 62 of each end of endboard E1. Position washer plates 166 such that their mounting bolt apertures 168 align with corresponding apertures 124 in bottom 62 of endboard E1. This effectively "sandwiches" bottom 62 of endboard E1 between two sets of washer plates 166.

With endboard E1 in place and apertures 124 and 168 properly aligned position a U-bolt 170 with threaded ends facing upward beneath and perpendicular to crossarm 142 such that its threaded ends align with mounting bolt apertures 168 of washer plate 166 already in place between crossarm 142 and storage endboard E1. With U-bolt 170 now properly aligned, raise it upward such that its threaded ends penetrate through apertures 168 of washer plate 166 in place between cot crossarm 142 and endboard E1, then through corresponding apertures 124 in bottom 62 of endboard E1, and finally through corresponding apertures 168 of washer plate 166 in place inside end storage compartment 122 of endboard E1. While holding U-bolt 170 in place with one hand, reach inside affected end storage compartment 122 and place washers 164 over exposed threaded ends of U-bolt 170. Follow this with wingnuts 162 that are then screwed clockwise onto threaded ends of U-bolt 170 drawing it upward against the lower surface of crossarm 142. Tighten wingnuts 162 only enough to hold U-bolt 170 loosely in place as this time. With assembly 160 loosely attached to one side of endboard E1, repeat the process with other assembly 160 on the other side of endboard E1. With assemblies 160 loosely attached to both sides of endboard E1, make final adjustments to position of endboard E1 on crossarm 142 as required. After final adjustments have been made, screw wingnuts 162 down clockwise simultaneously drawing U-bolts 170 tightly up against lower surface of crossarm 142 and endboard E1 tightly down against upper surface of crossarm 142. This secures endboard E1 to sleeping cot type C1. Although not depicted herein, the method and apparatus described herein also apply to attaching storage endboard E1 to sleeping cot type C2.

Locking of endboard E1 is effected by closing and latching lid 80 and threading the open conventional shackle (not shown) of a conventional padlock (not shown) through aligned eyelets 96 of upper and lower locking lugs 94 and 114 respectively and securing lock (not shown). When endboard E1 is closed and locked, U-bolts 170 cannot be removed from outside endboard E1 because wingnuts 162 are inside locked endboard E1.

FIGS. 3–5, 14–19—Second Mounting Application: Preferred Embodiment Endboard E1 and Cot Type C2

The first step of this two-part operation entails mounting storage endboard E1 to angular-frame sleeping cot type C2 using angular-frame arrester mounting bracket clamp assembly 260. The second step entails locking lid 80 of endboard E1 to container 60 of endboard E1. Although not referenced herein, the method and apparatus described also apply to alternative embodiment storage endboard E2.

Mounting of storage endboard E1 to angular-frame sleeping cot type C2 using clamp assembly 260 is effected as follows. With gap between arrester bracket base plate 280 and horizontal bracket member 286 facing cot crossarm 242, slide bracket 270 onto each end of crossarm 242 from inboard or outboard side of crossarm 242. Crossarm 242 at either end of cot type C2 may be used. Ensure crossarm 242 is cradled by base plate 280 against its upper surface, horizontal bracket member 286 against its lower surface, and vertical bracket member 284 against a side surface. Position brackets 270 such that large rectangular mounting bolt apertures 125 in base plates 280 and horizontal bracket members 286 align with their corresponding sleeping surface tensioning apertures 243 at each end of crossarm 242. With brackets 270 in position, carefully place endboard E1 atop base plates 280 with its externally—accessed storage compartment 72 facing inboard, toward center of cot type C2, such that apertures 125 of endboard E1 align with apertures 268 of base plates 280. Also, align cot siderail clearance housings 106 in bottom 62 of endboard E1 with siderails 244 of cot type C2 which protrude above the upper surface of crossarn 242. Endboard E1 may be mounted with its externally-accessed storage compartment 72 facing outboard, away from center of cot type C2. With endboard E1 in place, open lid 80 and reach inside end internally-accessed storage compartments 122 to place one-hole washer plate 266 over apertures 125 in bottom 62 of each end of endboard E1. Position washer plates 166 such that their apertures 268 align with corresponding apertures 125 in bottom 62 of endboard E1. This effectively "sandwiches" bottom 62 of endboard E1 between washer plates 266 and base plates 280.

With endboard E1 in place and apertures 125, 243, and 268 properly aligned, place large mounting bolt 272 upward first through aperture 125 in horizontal member 286 of arrester bracket 270; then through corresponding sleeping surface tensioning apertures 243 in upper and lower surfaces of one end of cot crossarm 242; then through corresponding aperture 125 in arrester bracket base plate 280; then through corresponding bolt aperture 125 in bottom 62 of endboard E1; and finally through corresponding aperture 268 of washer plate 266 in place inside end compartment 122 of endboard E1. While holding bolt 272 in place with one hand, reach inside affected end storage compartment 122 and place washer 264 over exposed threaded end of bolt 272. Follow this with wingnut 262 that is then screwed clockwise onto bolt 272 drawing endboard E1 down against upper surface of crossarm 242. At this time tighten wingnut 262 only enough to loosely hold endboard E1 in place on cot type C2. Repeat this process on the other side of endboard E1. With both clamp assemblies 260 loosely in place on opposites sides of cot type C2, make final adjustments in position of endboard E1 on crossarm 242 as necessary. Then screw wingnuts 262 clockwise down bolts 272 drawing endboard E1 tight against upper surface of crossarm 242 thereby securing endboard E1 to cot type C2.

Locking of endboard E1 is effected by closing and latching lid 80 and threading the open conventional shackle (not shown) of a conventional padlock (not shown) through aligned eyelets 96 of upper and lower locking lugs 94 and 114 respectively and securing lock (not shown). When endboard E1 is closed and locked, bolts 272 cannot be removed from outside because wingnuts 262 are inside locked endboard E1 and bolts 272 are prevented from turning by their square shank portions 276 tightly fitting into apertures 125 of brackets 270.

FIGS. 3–5, 20–25—Third Mounting Application: Preferred Embodiment Endboard E1 and Cot Type C3

The first step of this two-part operation entails mounting storage endboard E1 to tubular frame sleeping cot type C3 using tubular-frame anti-roll mounting bracket clamp assembly 360. The second step entails locking mating lid 80 of endboard E1 to container 60 of endboard E1. Although not referenced herein, the method and apparatus described also apply to alternative embodiment storage endboard E2.

Mounting of storage endboard E1 to cot type C3 using clamp assembly 360 is effected as follows. Balance two-hole washer plate 166 perpendicularly centered on upper surface of each end of cot crossarm 342 in the uncovered portion of crossarm 342 that lies between its transitional joint with siderail 344 and sleeping surface S3. Crossarm 342 at either end of cot type C3 may be used. Once washer plates 166 are in place, place endboard E1 atop washer plates 166 with its externally accessed storage compartment 72 facing inboard, toward center of cot type C3, such that small T-shaped mounting bolt apertures 124 in bottom 62 of endboard E1 align with corresponding elongated small mounting bolt apertures 168 of washer plates 166. It may be mounted with its externally-accessed storage compartment 72 facing outboard, away from center of cot type C3. Once endboard E1 is in place, open mating lid 80 and reach inside end internally-accessed storage compartments 122 to place one washer plate 166 over mounting bolt apertures 124 in bottom 62 of each end of endboard E1. Position washer plates 166 such that their apertures 168 align with corresponding apertures 124 in bottom 62 of endboard E1. This effectively "sandwiches" bottom 62 of endboard E1 between two sets of washer plates 166.

With endboard E1 in place and apertures 124 and 168 properly aligned, position anti-roll mounting bracket 370 beneath and perpendicular to cot crossarm 342. Position bracket 370 such that its small rectangular mounting bolt apertures 377 align with corresponding mounting bolt apertures 168 of washer plates 166 already in place between cot crossarm 342 and storage endboard E1. With bracket 370 properly aligned, raise it upwards cradling crossarm 342 in curved base 372 of bracket 370 until it contacts lower surface of crossarm 342. Maintain proper alignment of bracket apertures 377 with corresponding apertures 168 in washer plates 166 in place between cot crossarm 342 and storage endboard E1. While holding bracket 370 in place with one hand, position anti-roll outrigger 380 underneath and perpendicularly up against end of bracket 370 that is inboard of crossarm 342. Position outrigger 380 such that its elongated small rectangular mounting bolt aperture 387 aligns with inboard aperture 377 of bracket 370. Also, ensure cot siderail 344 is cradled in crooked end 384 of outrigger 380. While holding both bracket 370 and outrigger 380 in place with one hand, place mounting bolt 362 threaded end first upward through aperture 387 of outrigger 380; then through corresponding aperture 377 of bracket 370; then through corresponding aperture 168 of washer plate 166 in place between crossarm 342 and endboard E1 then through corresponding aperture 124 in bottom 62 of endboard E1: and finally through corresponding aperture 168 of washer plate 166 in place inside end storage compartment 122 of endboard E1. While holding bolt 362, outrigger 380, and bracket 370 in place with one hand, reach inside affected end storage compartment 122 and place small washer 164 over exposed threaded end of bolt 362. Follow this with small wingnut 162 which is then screwed clockwise onto bolt 362 drawing bracket 370 upward against lower surface of crossarm 342, and crooked end 384 of outrigger 380 upwards cradling lower surface of siderail 344. Tighten wingnut 162 only enough to hold bracket 370 and outrigger 380 loosely in place, then fasten another bolt 362 to opposite side of bracket 370 in the same fashion as above but without using another outrigger 380.

With clamp assembly 360 loosely attached to one side of endboard E1, repeat the process with remaining clamp assembly 360 on other side of endboard E1. With assemblies 360 loosely attached to both sides of endboard E1, make final adjustments in relationships of outriggers 380 to siderails 344, brackets 370 to crossarms 342, and endboard E1 to crossarm 342 as required. After final adjustments have been made, screw wingnuts 162 clockwise down bolts 362. This simultaneously draws both brackets 370 tightly up against lower surfaces of cot crossarms 342, crooked ends 384 of outriggers 380 tightly up against and cradling lower surfaces of siderails 344, and endboard E1 tightly down against crossarms 342. This secures endboard E1 to cot type C3.

Locking of endboard E1 is effected by closing and latching lid 80 and threading open conventional shackle (not shown) of a conventional padlock (not shown) through aligned eyelets 96 of upper and lower locking lugs 94 and 114 respectively and securing lock (not shown). When endboard E1 is closed and locked, bolts 362 cannot be removed from outside because wingnuts 162 are inside locked endboard E1 and bolts 362 are prevented from turning by their square shank portions 366 fitting tightly into rectangular apertures 377 of bracket 370.

FIGS. 3–5, 26–30–Fourth Mounting Application: Preferred Embodiment Endboard E1 and Cot Type C1

The first step of this two-part operation entails mounting storage endboard E1 to angular-frame sleeping cot type C1 using angular-frame adjustable mounting bracket clamp assembly 460. The second step entails locking mating lid 80 of endboard E1 to container 60 of endboard E1. Although not referenced herein, the method and apparatus described also apply to alternative embodiment storage endboard E2.

Mounting of storage endboard E1 to cot type C1 using clamp assembly 460 is effected as follows. Lay one two-hole washer plate 166 perpendicularly centered on the upper surface of each end of cot crossarm 142 in the uncovered portion of crossarm 142 that lies between its joint with siderail 144 and cot sleeping surface S1. Crossarm 142 at either end of cot type C1 may be used. With washer plate 166 in place at both ends of crossarm 142, place endboard E1 atop washer plates 166 with its externally accessed storage compartment 72 facing inboard, toward center of cot tape C1, such that small T-shaped mounting bolt apertures 124 in bottom 62 of endboard E1 align with elongated small mounting bolt apertures 168 in washer plates 166. Also, align cot siderail clearance housings 106 in bottom 62 of endboard E1 with siderails 144 of cot type C1 which protrude above upper surface of crossarm 142. With endboard E1 in place, open lid 80 and reach inside end internally-accessed storage compartments 122 to place one washer plate 166 over mounting bolt apertures 124 in bottom 62 of each side of endboard E1. Position washer plates 166 such that their mounting bolt apertures 168 align with corresponding apertures 124 in bottom 62 of endboard E1. This effectively "sandwiches" bottom 62 of endboard E1 between two sets of washer plates 166.

With endboard E1 in place and apertures 124 and 168 properly aligned, prepare an adjustable mounting bracket 470 for attachment to endboard E1. First assemble bracket 470 as discussed above. Then adjust gap between male 480 and female 490 bracket components to accommodate width of crossarm 142. To accomplish this, loosen thumbscrew 500 by turning it counterclockwise and slide male 480 and female 490 bracket components toward or away from each other accordingly. Once adjustment has been made, tighten thumbscrew 500 by turning it clockwise only enough to keep components 480 and 490 loosely in position at this time.

With bracket 470 assembled and properly adjusted, position it beneath and perpendicular to crossarm 142 such that its mounting bolt apertures 377 align with corresponding mounting bolt apertures 168 of washer plate 166 already in place between crossarm 142 and storage endboard E1. With bracket 470 now properly aligned, raise it upwards cradling crossarn 142 between its male 480 and female 490 components until it contacts the lower surface of crossarm 142. Maintain proper alignment of apertures 377 in bracket 470 with corresponding apertures 168 in washer plate 166 in place between crossarm 142 and endboard E1. While holding bracket 470 in place with one hand, place small mounting bolt 362 threaded end first upward through either aperture 377 of bracket 470: then through corresponding aperture 168 of washer plate 166 in place between cot crossarm 142 and endboard E1 ; then through corresponding aperture 124 in bottom 62 of endboard E1 ; and finally through corresponding aperture 168 of washer plate 166 in place inside end storage compartment 122 of endboard E1. While holding both bracket 470 and bolt 362 in place with one hand, reach inside affected end storage compartment 122 and place washer 164 over exposed threaded end of bolt 362. Follow this with wingnut 162 that is then screwed clockwise onto bolt 362 drawing bracket 470 upward against the lower surface of crossarm 142. Tighten wingnut 162 only enough to hold bracket 470 loosely in place, then fasten another bolt 362 to the opposite side of bracket 470 in the same fashion as above. With assembly 460 loosely attached to one side of endboard E1, repeat the process with other assembly 460 on the other side of endboard E1. With assemblies 460 loosely attached to both sides of endboard E1, make final adjustments to adjustable components 480 and 490 of brackets 470, and position of endboard E1 on crossarm 142 as required. After final adjustments have been made, tighten thumbscrews 500 by screwing them clockwise. Once thumbscrews 500 are tight, screw wingnuts 162 down clockwise simultaneously drawing brackets 470 tightly up against lower surface of crossarm 142, and endboard E1 tightly down against upper surface of crossarm 142. This secures endboard E1 to sleeping cot type C1. The method and apparatus described herein also applies to attaching storage endboard E1 to sleeping cot type C2.

Locking of endboard E1 is effected by closing and latching lid 80 and threading open conventional shackle (not shown) of a conventional padlock (not shown) through aligned eyelets 96 of upper and lower locking lugs 94 and 114 respectively and securing lock (not shown). When endboard E1 is closed and locked, bolts 362 cannot be removed from outside endboard E1 because wingnuts 162 arc inside locked endboard E1 and bolts 362 are prevented from turning by their square shank portions 366 fitting tightly into rectangular apertures 377 of bracket 470. Even with thumbscrew 500 removed, adjustable male 480 and female 490 components of bracket 470 cannot be pulled or rotated apart far enough to effect the removal of endboard E1 from cot type C1.

Conclusion, Ramifications, and Scope

Accordingly, the reader will see that the clamp-on, portable storage endboard for a sleeping cot of this invention can be used to proximately and protectively store articles on a sleeping cot. Such storage is an extremely important quality-of-life factor for people quartered under field conditions in cot-based sleeping environments such as camping, military bivouac, or temporary emergency sheltering. For typically under these conditions storage space is extremely limited and secure storage space even mores. Unlike the few other devices available for such duty, my endboard can safely store items that arc fragile, valuable, or of potentially immediate need in a cot-based sleeping environment. These items include, but are not limited to, eyeglasses, flashlights, wallets, money clips, watches, jewelry, keys, medicines, cellular phones, cameras, pagers, and, in some cases, small personal defense weapons.

These items are protected from damage because they are stored inside a container vice outside, in an exposed position, as with other devices. And they are protected from theft because the endboard is mounted on the cot in such a manner that, when locked, it cannot be removed from the cot without obvious damage to either itself or the cot. Furthermore, the storage endboard has additional advantages in that

- it can be quickly and easily mounted and demounted to and from a variety of sleeping cots through the use of simple yet effective correlating mounting bracket clamp assemblies; and
- it can be mounted and demounted to a variety of sleeping cots without the use of tools; and
- it provides stationary and portable storage of articles in that it can store articles both while mounted on a sleeping cot and in transit thereto and therefrom, and
- it provides storage for articles of different sizes and shapes in its differently sized and shaped storage compartments; and
- when used as a headboard, it retains a pillow in place at the head of the sleeping cot; and
- it serves as a console to house amenities that include but arc not limited to a beverage holder, reading light, digital alarm clock, and radio.

Although the description above contains much specificity, these should not be construed as limiting the scope of my endboard but as merely providing illustrations of some of the presently preferred embodiments of my endboard. For example,

- although the preferred embodiment endboard is approximately 8 inches high, 30 inches long, and 4 inches wide, it can be rendered in a variety of sizes such as 10"×32×"5"; and
- the endboard can have other shapes such as circular, oval, trapezoidal, triangular, etc., and
- it can be rendered in different formats such as a one-piece unit with pullout drawers or foldout storage platforms; and
- if rendered as a two-piece structure, access to the container can be had from the side vice the top and via a door or panel vice a lid; and
- it can be constructed of a variety of materials such as plastic, metal, or composite material and be rendered in any color combination such as a monochromatic green or a polychromatic camouflage pattern; and
- its lid can be connected to its container by mechanisms other than a hinge, such as latches at its front and back; and
- its storage compartments can be rendered in many different configurations such as varying the number, size, and relative location of internally-accessed and eternally-accessed compartments; and its locking mechanism can take many forms such as lockable latches that require a key to operate like those found on briefcases and the like: and mounting methods can comprise devices other than U-bolts and brackets. such as screw type C-clamps; and its amenities can include multiple beverage holders of varying sizes and configurations, combination clock and radio, and infinite variations of lights for reading or area illumination, the latter of which could be automatically actuated by the opening of the lid, door, or panel.

Thus the scope of the invention should be determined by the appended claims and their legal equivalents, rather than by the examples given.

I claim:

1. A storage endboard for demountable attachment to a variety of Sleeping cots comprising:

(a) a rigid container of predetermined height, length, width, and cross-sectional shape, with an open top, a bottom, a front wall, a back wall, a left wall, and a right wall, and (b) a plurality, of interior sidewalls recessed within said container bounding a plurality of storage compartments, and (c) a mating lid pivotally connected to said container with an upper surface, a lower surface, a front, a back, a left end, and a right end, and (d) variable first means, including an angular frame u-bolt mounting bracket clamp assembly, for demountably attaching said container to said sleeping cots, whereby said container can be demountably attached to said sleeping cots, and whereby an individual occupying said sleeping cots can conveniently store a variety of articles.

2. The endboard of claim 1 further including a plurality of mounting bolt apertures in said bottom of said container to facilitate said first means for demountably attaching said container to said sleeping cots.

3. The endboard of claim 1 further including a plurality of cot siderail clearance housings in said bottom of said container to facilitate said first means for demountably attaching said container to said sleeping cots.

4. The endboard of claim 1 further including second means for releasably coupling said front of said lid to said front wall of said container in a closed position.

5. The endboard of claim 4 wherein said second means for releasably coupling said front of said lid to said front wall of said container in said closed position comprises a plurality of latches.

6. The endboard of claim 1 further including third means for reversibly locking said lid to said container in said closed position, whereby said articles stored within said container are afforded a measure of protection from damage and theft while said lid is locked in said closed position and said container is attached to said sleeping cots or in transit thereto or therefrom.

7. The endboard of claim 6 wherein said third means for reversibly locking said lid to said container in said closed position comprises a plurality of locking lugs.

8. The endboard of claim 1 wherein said variable first means for demountably attaching said container to said sleeping cots includes an angular-frame arrester mounting bracket clamp assembly.

9. The endboard of claim 1 wherein said variable first means for demountably attaching said container to said sleeping cots includes an angular-frame adjustable mounting bracket clamp assembly.

10. The endboard of claim 1 wherein said variable first means for demountably attaching said container to said sleeping cots includes a tubular-frame anti-roll mounting bracket clamp assembly.

11. The endboard of claim 1 further including a beverage holder recessed into said upper surface of said lid.

12. The endboard of claim 1 further including a pliable carrying handle disposed through the center of said upper surface of said lid.

13. The endboard of claim 1 further including a dual-purpose, retractable light recessed into said upper surface of said lid.

14. The endboard of claim 1 future including an am/fm/weather radio recessed into said upper surface of said lid.

15. The endboard of claim 1 further including a digital clock recessed into said front wall of said container.

16. A method of storing a variety of articles on a variety of sleeping cots comprising:

(a) providing a rigid container of predetermined height, length, width, and cross-sectional shape, with an open top, a bottom, a front wall, a back wall, a left wall, and a right wall, and (b) providing a plurality of interior sidewalls recessed within said container bounding a plurality of storage compartments, and (c) providing a mating lid pivotally connected to said container with an upper surface, a lower surface, a front, a back, a left end, and a right end, and (d) providing variable first means, including a plurality of angular frame u-bolt mounting bracket clamp assemblies, for demountably attaching said container to said sleeping cots, and (e) attaching said container to said sleeping cots, and (f) storing said articles in said storage compartments within said container, and (g) providing second means, including a plurality of latches, for releasably coupling said lid to said container in a closed position, and (h) providing third means, including a plurality of locking lugs, for reversibly locking said lid to said container in said closed position, and (i) providing a pliable carrying handle disposed to the center of said lid, whereby an individual occupying said sleeping cots can conveniently access said articles at will, and whereby said articles stored within said container are afforded a measure of protection from damage and theft while said lid is locked in said closed position and said container is attached to said sleeping cots or in transit thereto or therefrom.

17. The method of claim 16 further including the step of providing a plurality of mounting bolt apertures and a plurality of cot siderail clearance housings in said bottom of said container to facilitate demountable attachment of said container to said sleeping cots.

18. The method of claim 16 further including the step of providing a beverage holder recessed into said upper surface of said lid.

19. The method of claim 16 further including the step of providing a dual-purpose, retractable light recessed into said upper surface of said lid.

20. The method of claim 16 further including the step of providing an am/fm/weather radio recessed into said upper surface of said lid.

21. The method of claim 16 further including the step of providing a digital alarm clock disposed to said front wall of said container.

* * * * *